US011156934B2

(12) United States Patent
Yoshihara et al.

(10) Patent No.: US 11,156,934 B2
(45) Date of Patent: Oct. 26, 2021

(54) CARRIER FOR DEVELOPING ELECTROSTATIC CHARGE IMAGE, ELECTROSTATIC CHARGE IMAGE DEVELOPER, AND IMAGE FORMING APPARATUS

(71) Applicant: FUJIFILM Business Innovation Corp., Tokyo (JP)

(72) Inventors: Kotaro Yoshihara, Kanagawa (JP); Asafumi Fujita, Kanagawa (JP); Teppei Yawada, Kanagawa (JP); Motoko Sakai, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/945,122

(22) Filed: Jul. 31, 2020

(65) Prior Publication Data

US 2021/0286284 A1 Sep. 16, 2021

(30) Foreign Application Priority Data

Mar. 11, 2020 (JP) ..... JP2020-042288

(51) Int. Cl.

| | |
|---|---|
| ***G03G 9/097*** | (2006.01) |
| ***G03G 9/107*** | (2006.01) |
| ***G03G 9/113*** | (2006.01) |
| ***G03G 9/093*** | (2006.01) |
| ***G03G 9/08*** | (2006.01) |
| ***G03G 9/083*** | (2006.01) |
| ***G03G 9/087*** | (2006.01) |

(52) U.S. Cl.

CPC ..... *G03G 9/107* (2013.01); *G03G 9/0821* (2013.01); *G03G 9/0825* (2013.01); *G03G 9/0839* (2013.01); *G03G 9/08711* (2013.01); *G03G 9/09314* (2013.01); *G03G 9/09791* (2013.01); *G03G 9/1131* (2013.01)

(58) Field of Classification Search

CPC .... G03G 9/113; G03G 9/1134; G03G 9/1131; G03G 9/1139

See application file for complete search history.

(56) References Cited

U.S. PATENT DOCUMENTS

2009/0103953 A1* 4/2009 Tokutake ..... G03G 5/14704 399/259

FOREIGN PATENT DOCUMENTS

| | | | |
|---|---|---|---|
| JP | 64-033559 | A | 2/1989 |
| JP | 5-061261 | A | 3/1993 |
| JP | 10-333363 | A | 12/1998 |
| JP | 2007-121911 | A | 5/2007 |
| JP | 2008-304772 | A | 12/2008 |

(Continued)

*Primary Examiner* — Peter L Vajda

(74) *Attorney, Agent, or Firm* — Sughrue Mion, PLLC

(57) ABSTRACT

A carrier for developing an electrostatic charge image has magnetic particles and a resin coating that covers the magnetic particles and contains at least one lubricant. The resin coating has a dispersed phase of the lubricant and meets requirement (1).

Requirement (1): the lubricant content in a top layer>the lubricant content in a middle layer>the lubricant content in a bottom layer The top, middle, and bottom layers are of the resin coating divided into three in the direction of thickness, and the lubricant content is the percentage area of the dispersed phase of the lubricant in a cross-section of the layer taken along the thickness thereof.

18 Claims, 5 Drawing Sheets

(56) References Cited

FOREIGN PATENT DOCUMENTS

| | | | |
|---|---|---|---|
| JP | 2012-203292 | A | 10/2012 |
| JP | 2019-184831 | A | 10/2019 |

* cited by examiner

CARRIER FOR DEVELOPING ELECTROSTATIC CHARGE IMAGE, ELECTROSTATIC CHARGE IMAGE DEVELOPER, AND IMAGE FORMING APPARATUS

CROSS-REFERENCE TO RELATED APPLICATIONS

This application is based on and claims priority under 35 USC 119 from Japanese Patent Application No. 2020-042288 filed Mar. 11, 2020.

BACKGROUND

(i) Technical Field

The present disclosure relates to a carrier for developing an electrostatic charge image, an electrostatic charge image developer, and an image forming apparatus.

(ii) Related Art

Japanese Unexamined Patent Application Publication No. 2008-304772 discloses a carrier for developing an electrostatic charge image. The carrier has magnetic particles and a coating layer covering the surface of the magnetic particles, and these two elements form carrier base particles. The carrier also has particles containing a lubricant, and these particles are adhering to the surface of the carrier base particles. The volume-average diameter of the lubricant-containing particles is 1/50 or more and 1/3 or less of that of the carrier base particles.

Japanese Unexamined Patent Application Publication No. 64-33559 discloses a carrier for electrophotography. The carrier has a silicone-resin coating layer containing a metal salt of a fatty acid.

Japanese Unexamined Patent Application Publication No. 5-61261 also discloses a carrier for electrophotography. This carrier is coated with a domain-matrix resin composition that contains a metal salt of a fatty acid.

Japanese Unexamined Patent Application Publication No. 10-333363 also discloses a carrier for electrophotography. This carrier has a resin coating layer that contains electrically conductive spherical particles and lubricant particles.

Japanese Unexamined Patent Application Publication No. 2007-121911 also discloses a carrier for electrophotography. This carrier has inner and outer resin coat layers, and the inner layer contains nonmagnetic particles.

Japanese Unexamined Patent Application Publication No. 2012-203292 also discloses a carrier for electrophotography. This carrier has a resin coating layer containing a metal salt of a fatty acid. The metal salt of a fatty acid is more abundant on the core-particle side of the coating layer than on the surface side.

Japanese Unexamined Patent Application Publication No. 2019-184831 also discloses a carrier for electrophotography. This carrier has a coat layer that contains a metal salt of a fatty acid and metal-oxide particles.

SUMMARY

Aspects of non-limiting embodiments of the present disclosure relate to a carrier for developing an electrostatic charge image developer. The carrier has magnetic particles and a resin coating that covers the magnetic particles and contains at least one lubricant. With carriers for developing electrostatic charge images made with a resin coating in which the lubricant content is the smallest in its top layer, intermediate in its middle layer, and the largest in its bottom layer (top<middle<bottom), the image carrier of the image forming apparatus used therewith has worn unevenly. This carrier provides long-term reduction of this uneven wear of the image carrier.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a carrier for developing an electrostatic charge image. The carrier has magnetic particles and a resin coating that covers the magnetic particles and contains at least one lubricant. The resin coating has a dispersed phase of the lubricant and meets requirement (1).

Requirement (1): a lubricant content in a top layer>a lubricant content in a middle layer>a lubricant content in a bottom layer The top, middle, and bottom layers are of the resin coating divided into three in a direction of thickness, and the lubricant content is a percentage area of the dispersed phase of the lubricant in a cross-section of the layer taken along a thickness thereof.

BRIEF DESCRIPTION OF THE DRAWINGS

Exemplary embodiments of the present disclosure will be described in detail based on the following figures, wherein.

DETAILED DESCRIPTION

The following describes exemplary embodiments of the present disclosure. The following description and Examples are merely examples of the exemplary embodiments and do not limit the scope of the exemplary embodiments.

Numerical ranges specified with "A-B," "between A and B," "(from) A to B," etc., herein represent inclusive ranges, which include minimum A and maximum B as well as all values in between.

The present disclosure also mentions series of numerical ranges. The upper or lower limit of one of such numerical ranges may be substituted with the upper or lower limit of another numerical range in the same series. The upper or lower limit of a numerical range herein may be substituted with a value specified in Examples.

A gerund or action noun in the description of a certain process or method herein does not always represent an independent action. As long as its purpose is fulfilled, the action represented by the gerund or action noun may be continuous with or part of another.

A description of an exemplary embodiment herein may make reference to drawing(s). The reference, however, does not mean that what is illustrated is the only possible configuration of the exemplary embodiment. The size of elements in each drawing is conceptual; the relative sizes of the elements do not need to be as illustrated.

An ingredient herein may be a combination of multiple substances. If a composition described herein contains a combination of multiple substances as one of its ingredients, the amount of the ingredient represents the total amount of the substances in the composition unless stated otherwise.

An ingredient herein, furthermore, may be a combination of multiple kinds of particles. If a composition described herein contains a combination of multiple kinds of particles as one of its ingredients, the particle diameter of the ingredient is that of the mixture of the multiple kinds of particles present in the composition.

As used herein, the term "(meth)acrylic" represents at least one of acrylic and methacrylic. The term "(meth) acrylate" represents at least one of an acrylate and a methacrylate.

As used herein, the term "toner" represents a toner for developing an electrostatic charge image. "A carrier for developing an electrostatic charge image" herein may be simply referred to as "a carrier," and "an electrostatic charge image developer" herein may be simply referred to as "a developer."

Carrier for Developing an Electrostatic Charge Image

A carrier according to an exemplary embodiment has magnetic particles and a resin coating that covers the magnetic particles and contains at least one lubricant. The resin coating has a dispersed phase of the lubricant. The following describes parameters concerning the dispersed phase of the lubricant in the resin coating with reference to FIGS. 1 and 2.

Figure 1:
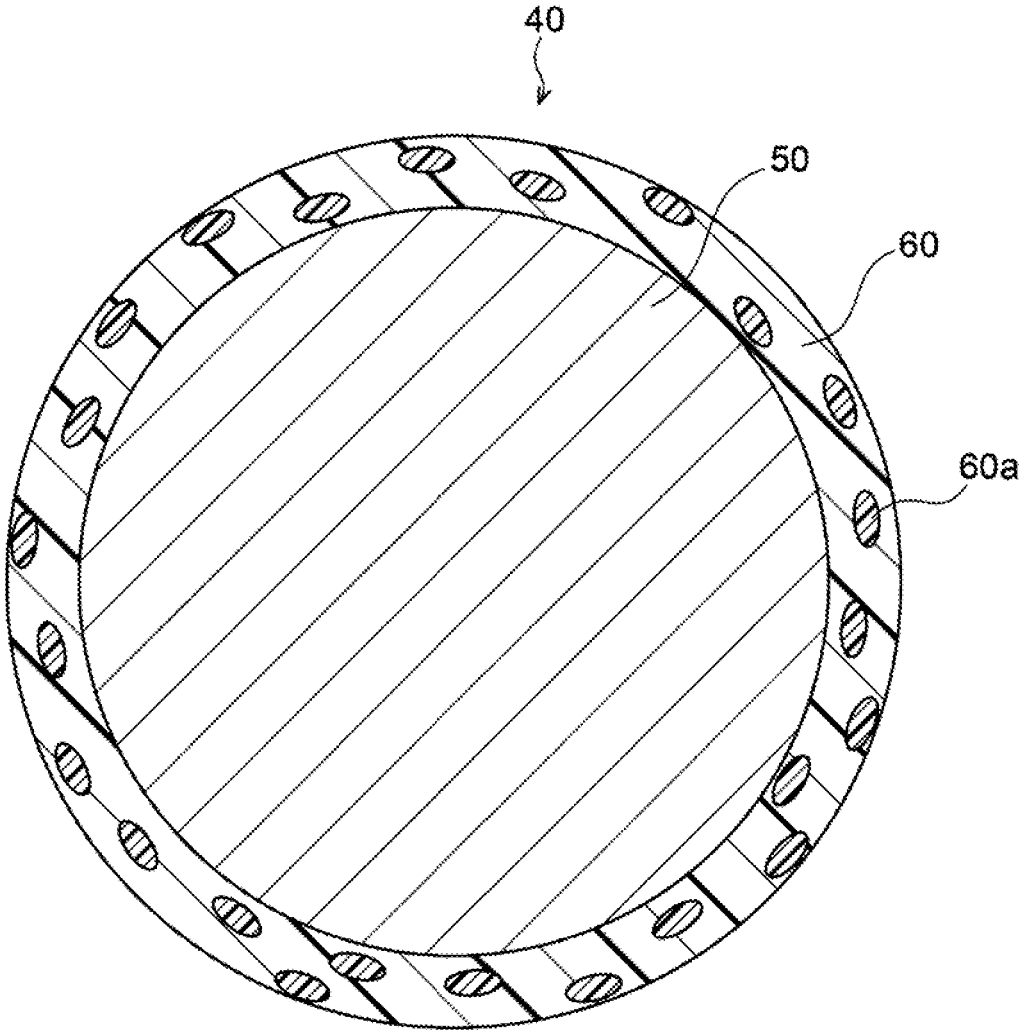
FIG. 1 is a schematic cross-sectional diagram for describing the resin coating of a carrier according to an exemplary embodiment.

FIG. 1 schematically illustrates a cross-section of a carrier particle. The carrier particle 40 illustrated in FIG. 1 has a magnetic particle 50 and a resin coating 60 that covers the magnetic particle 50. The resin coating 60 contains at least one lubricant and includes a dispersed phase 60*a* of the lubricant.

In the carrier according to this exemplary embodiment, the magnetic particles 50 may be completely covered with the resin coating 60 as in FIG. 1, or the magnetic particles 50 may be partially covered with the resin coating 60 (in other words, the magnetic particles 50 may be partially exposed).

Figure 2:
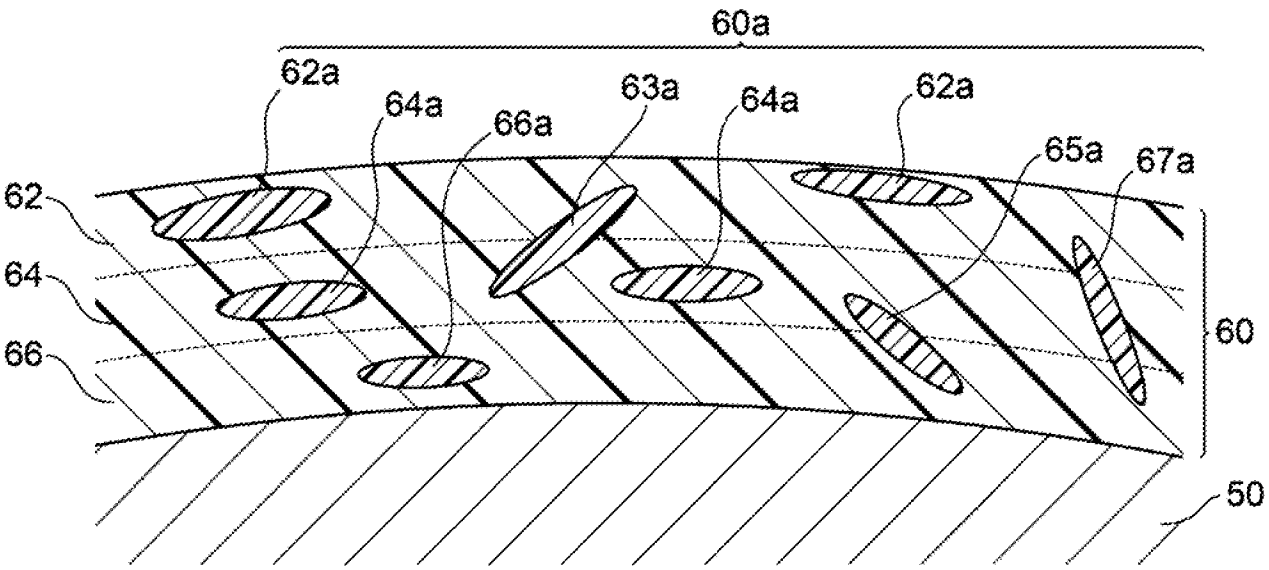
FIG. 2 is an enlarged view of part of FIG. 1.

FIG. 2, an enlarged view of part of FIG. 1, illustrates part of the magnetic particle 50 and the resin coating 60. In FIG. 2, the broken lines inside the resin coating 60 indicate the borders between three layers of the resin coating 60 divided in the direction of thickness (how to divide the coating into three is described later herein). The layer closest to the surface of the resin coating 60 is a top layer 62, the next is a middle layer 64, and the farthest is a bottom layer 66.

The resin coating 60 includes a dispersed phase 60*a* of the lubricant. The dispersed phase 60*a* includes portions 62*a*, 63*a*, 64*a*, 65*a*, 66*a*, and 67*a*. The portions 62*a* are portions of the dispersed phase 60*a* of the lubricant entirely contained in the top layer 62. The portions 63*a* are portions of the dispersed phase 60*a* of the lubricant contained part of which is in the top layer 62 and the rest in the middle layer 64. The portions 64*a* are portions of the dispersed phase 60*a* of the lubricant entirely contained in the middle layer 64. The portions 65*a* are portions of the dispersed phase 60*a* of the lubricant part of which is in the middle layer 64 and the rest in the bottom layer 66. The portions 66*a* are portions of the dispersed phase 60*a* of the lubricant entirely contained in the bottom layer 66. The portions 67*a* are portions of the dispersed phase 60*a* of the lubricant part of which is in the top layer 62, another part in the middle layer 64, and the rest in the bottom layer 66.

The lubricant content in the top layer 62 represents the percentage (%) of the area of the dispersed phase in the top layer 62 to the total area of the top layer 62. The area of the dispersed phase in the top layer 62 is the total area of the portions 62*a*, the part of the portions 63*a* contained in the top layer 62, and the part of the portions 67*a* contained in the top layer 62.

The lubricant content in the middle layer 64 represents the percentage (%) of the area of the dispersed phase in the middle layer 64 to the total area of the middle layer 64. The area of the dispersed phase in the middle layer 64 is the total area of the portions 64*a*, the part of the portions 63*a* contained in the middle layer 64, the part of the portions 65*a* contained in the middle layer 64, and the part of the portions 67*a* contained in the middle layer 64.

The lubricant content in the bottom layer 66 represents the percentage (%) of the area of the dispersed phase in the bottom layer 66 to the total area of the bottom layer 66. The area of the dispersed phase in the bottom layer 66 is the total area of the portions 66*a*, the part of the portions 65*a* contained in the bottom layer 66, and the part of the portions 67*a* contained in the bottom layer 66.

The mean major axis of the dispersed phase of the lubricant in the top layer 62 is the arithmetic mean of the major axes of the portions 62*a*.

The mean major axis of the dispersed phase of the lubricant in the middle layer 64 is the arithmetic mean of the major axes of the portions 64*a*.

The mean major axis of the dispersed phase of the lubricant in the bottom layer 66 is the arithmetic mean of the major axes of the portions 66*a*.

It should be noted that the calculation of the mean major axis of the dispersed phase of the lubricant in each layer excludes the portions reaching two or three layers, i.e., the portions 63*a*, 65*a*, and 67*a*.

The aspect ratio of the dispersed phase of the lubricant in the resin coating 60 is that across the entire dispersed phase 60*a* of the lubricant (i.e., the portions 62*a*, 63*a*, 64*a*, 65*a*, 66*a*, and 67*a*) and is determined by arithmetically averaging the aspect ratio (major axis/minor axis) of each set of portions.

The following describes how to measure parameters concerning the resin coating and those concerning the dispersed phase of the lubricant.

A sample and an image for measurement are prepared as follows.

The carrier is mixed into epoxy resin, and the epoxy resin is solidified. The solid resin is sliced using an ultramicrotome to a thickness of 100 nm or more and 200 nm or less, and the resulting thin-section sample is imaged by scanning electron microscopy (SEM) using an ultrahigh-resolution field-emission scanning electron microscope (FE-SEM) (e.g., Hitachi High-Technologies S-4800). The SEM image obtained is analyzed using image analysis software (WinROOF 2015, Mitani Corporation).

Usually, the outlines of portions of the dispersed phase of the lubricant are visible by virtue of the difference in brightness (contrast) between the lubricant and the resin component that forms the continuous phase of the resin coating. If the outlines of portions of the dispersed phase of the lubricant are difficult to recognize because of low contrast, the thin-section sample is stained with ruthenium tetroxide in a desiccator before SEM imaging. If the outlines of portions of the dispersed phase of the lubricant remain vague even after staining, metal elements are mapped on a cross-section of the thin-section sample to visualize the outlines of portions of the dispersed phase of the lubricant.

In the SEM image, the cross-sections of carrier particles have varying sizes. Of these, randomly selected 100 having a diameter equal to or longer than 85% of the volume-average diameter of the carrier particles are observed. The diameter of a cross-section of a carrier particle in this context refers to the longest distance between any two points on the outline of the cross-section (so-called absolute maximum length).

The selection of such cross-sections of carrier particles is because cross-sections having a diameter shorter than 85% of the volume-average diameter of the particles are probably near an end of the particles. Near-end cross-sections do not well reflect the condition of the dispersed phase in the resin coating of the carrier particles.

The selected 100 cross-sections of carrier particles are used to determine parameters concerning the resin coating and also to determine those concerning the dispersed phase of the lubricant.

The average thickness of the resin coating is determined by measuring the thickness (μm) of the resin coating at randomly selected 100 points per carrier particle. The average thickness (μm) of the resin coating of each carrier particle is the arithmetic mean thickness of 100 points, and the average thickness (μm) of the resin coating in the carrier as a whole is given by arithmetically averaging that of 100 carrier particles.

The top, middle, and bottom layers of the resin coating are determined as follows.

The center of gravity of each carrier particle, or more specifically the center of area of a cross-section (region formed by a magnetic particle and the resin coating) of each carrier particle, is determined using image analysis software.

Lines from points on the surface of the resin coating to the center of gravity of the carrier particle are divided into three on the basis of the average thickness of the resin coating, i.e., the average thickness of the resin coating of the particular carrier particle. The portion from the surface of the resin coating to ⅓ of the average thickness is the top layer, the portion from ⅓ to ⅔ of the average thickness is the middle layer, and the portion from ⅔ of the average thickness to the surface of the magnetic particle is the bottom layer.

Near where the magnetic particle is exposed (portions covered with a relatively thin resin coating), the resin coating may lack the middle and bottom layers. At depressions in the magnetic particle (portions covered with a relatively thick resin coating), the bottom layer may be thicker than the top and middle layers.

Figure 3:
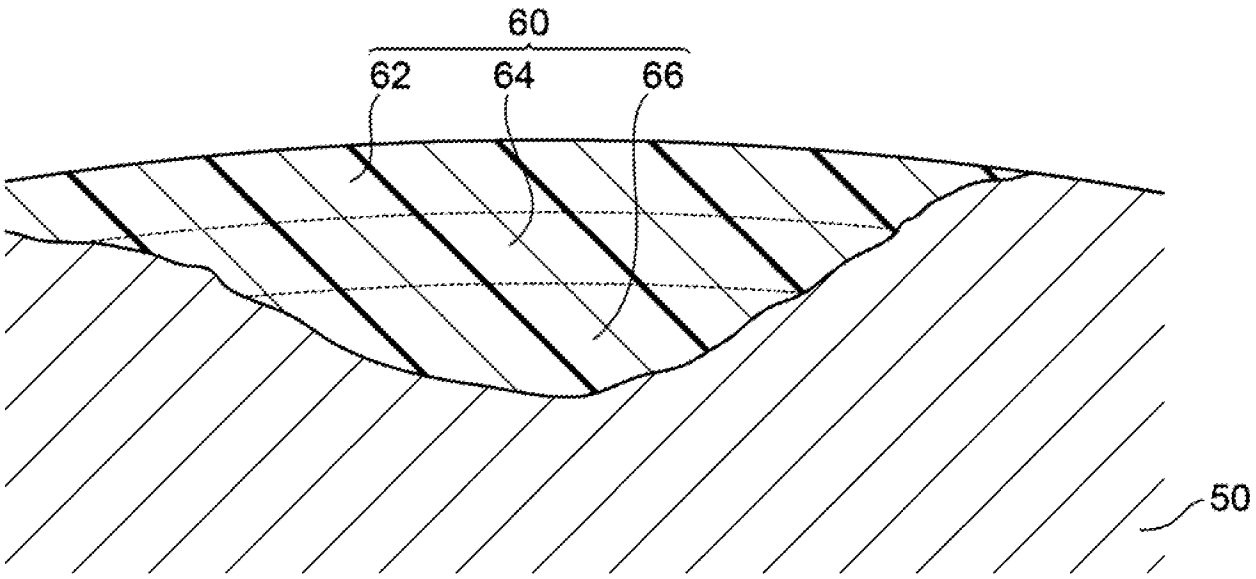
FIG. 3 is a schematic cross-sectional diagram for describing the top, middle, and bottom layers of the resin coating of a carrier according to an exemplary embodiment.

FIG. 3 schematically illustrates the resin coating 60 and its top, middle, and bottom layers 62, 64, and 66 near an exposed portion of a magnetic particle 50.

The areas of the top, middle, and bottom layers of the resin coating are determined using image analysis software.

The measurement of parameters concerning the dispersed phase of the lubricant includes all portions of the dispersed phase of the lubricant seen in the resin coating.

The areas of the portions of the dispersed phase of the lubricant are determined using image analysis software.

The major axis of a portion of the dispersed phase of the lubricant is the longest distance between any two points on the outline of the portion (so-called absolute maximum length) (μm). The major axis (μm) of the dispersed phase of the lubricant in the carrier as a whole is given by arithmetically averaging that of all portions of the dispersed phase of the lubricant seen in the resin coating of 100 carrier particles.

The minor axis of a portion of the dispersed phase of the lubricant is the distance (μm) between two straight lines parallel to the major axis of the portion and touching the portion from the outside. The minor axis (μm) of the dispersed phase of the lubricant in the carrier as a whole is given by arithmetically averaging that of all portions of the dispersed phase of the lubricant seen in the resin coating of 100 carrier particles.

The aspect ratio of a portion of the dispersed phase of the lubricant is the fraction of the major axis (μm) of the portion divided by the minor axis (μm) (major axis/minor axis). The mean aspect ratio of the dispersed phase of the lubricant in the carrier as a whole is given by arithmetically averaging that of all portions of the dispersed phase of the lubricant seen in the resin coating of 100 carrier particles.

The following describes a feature of the carrier according to this exemplary embodiment.

The carrier according to this exemplary embodiment meets requirement (1).

Requirement (1): the lubricant content in the top layer>the lubricant content in the middle layer>the lubricant content in the bottom layer The top, middle, and bottom layers are of the resin coating divided into three in the direction of thickness, and the lubricant content is the percentage area of the dispersed phase of the lubricant in a cross-section of the layer taken along the thickness thereof.

By virtue of meeting requirement (1), the carrier according to this exemplary embodiment provides long-term reduction of uneven wear of the image carrier of the image forming apparatus used therewith. A possible reason is as follows.

In the related art, lubricants have been added, as external additives, to toner particles. The lubricant added is supplied to the surface of the image carrier of the image forming apparatus used with the toner. This technology, however, causes the ends of the image carrier (both longitudinal ends of the image carrier) to wear easily because these portions are used in image formation relatively infrequently and therefore are supplied with relatively small amounts of lubricant. Image formation with an image carrier having worn ends may cause defects (fog, voids, black spots, etc.) in the corresponding portions of the formed images.

In another technology developed to address this, the lubricant is supplied to the surface of the image carrier by attaching the lubricant to the surface of carrier particles or by adding the lubricant as an internal additive to a resin coating on carrier particles. The carrier particles adhere to the entire longitudinal length of the developing component and come into contact with the surface of the image carrier over the entire longitudinal length of the image carrier. This helps reduce uneven wear of the image carrier at its ends.

Attaching a lubricant to the surface of carrier particles, however, only provides relatively short-term reduction of the wear of the image carrier because the lubricant in this case is exhausted relatively soon. Adding a lubricant as an internal additive to a resin coating on carrier particles may involve a relatively long delay before the lubricant provides effective reduction of the wear of the image carrier or may lead to faster degradation of the carrier particles by causing the resin coating to detach from the core magnetic particles.

The carrier according to this exemplary embodiment appears to have the following effects (a) to (d) by virtue of the gradient of requirement (1) in the dispersed phase of the lubricant in the resin coating.

(a) Owing to the higher lubricant content in the top layer than in the middle and bottom layers, the lubricant is supplied to and forms a coating on the surface of the image carrier relatively soon after the start of use. The wear of the image carrier is therefore reduced relatively early.

(b) Owing to the second highest lubricant content in the middle layer, following that in the top layer, the lubricant continues to be supplied to the surface of the image carrier, and therefore the wear of the image carrier continues to be reduced, even after the top layer has worn away during repeated image formation.

(c) Owing to the lower lubricant content in the bottom layer than in the middle and top layers, the resin coating does not detach from the magnetic particles easily. This ensures sustained supply of the lubricant from carrier particles to the surface of the image carrier and therefore sustained reduction of the wear of the image carrier.

(d) Owing to the supply of lubricant from carrier particles to the image carrier, the lubricant spreads over the entire longitudinal length of the image carrier. Uneven wear is therefore reduced.

As a combined outcome of (a) to (d), the inventors believe, the carrier according to this exemplary embodiment provides long-term reduction of uneven wear of the image carrier of the image forming apparatus used therewith.

The lubricant content in the top layer may be 20% or more and 70% or less, preferably 20% or more and 60% or less, more preferably 25% or more and 50% or less, even more preferably 30% or more and 50% or less.

The lubricant content in the middle layer may be 10% or more and 60% or less, preferably 10% or more and 50% or less, more preferably 10% or more and 35% or less, even more preferably 10% or more and 30% or less.

The lubricant content in the bottom layer may be 0% or more and 35% or less, preferably 0% or more and 30% or less, more preferably 0% or more and 25% or less, even more preferably 0% or more and 20% or less.

The ratio between the lubricant content in the top layer and that in the middle layer (top layer/middle layer) may be 1.5 or more and 4.0 or less, preferably 1.8 or more and 4.0 or less, more preferably 2.0 or more and 3.0 or less, even more preferably 2.0 or more and 2.5 or less.

The lubricant content of the resin coating as a whole may be 20% or more and 50% or less, preferably 30% or more and 50% or less, more preferably 40% or more and 50% or less.

The carrier according to this exemplary embodiment may further meet requirement (2).

Requirement (2): the mean major axis of the dispersed phase of the lubricant in the top layer>the mean major axis of the dispersed phase of the lubricant in the middle layer>the mean major axis of the dispersed phase of the lubricant in the bottom layer The top, middle, and bottom layers are of the resin coating divided into three in the direction of thickness, and the mean major axis of the dispersed phase of the lubricant is the arithmetic mean of the major axes of portions of the dispersed phase of the lubricant entirely contained in the layer.

Ensuring the gradient of requirement (2) appears to make effects (a) to (c) take place more efficiently and therefore lead to long-term reduction of uneven wear of the image carrier.

If the lubricant is a metal salt of a fatty acid (e.g., zinc stearate), the mean major axis of the dispersed phase of the lubricant in each layer may be as follows.

The mean major axis of the dispersed phase of the lubricant in the top layer may be 0.1 μm or more, preferably 0.5 μm or more, more preferably 1.0 μm or more, and may be 2.5 μm or less, preferably 2.0 μm or less, more preferably 1.8 μm or less.

The mean major axis of the dispersed phase of the lubricant in the middle layer may be 0.1 μm or more, preferably 0.5 μm or more, more preferably 1.0 μm or more, and may be 2.0 μm or less, preferably 1.8 μm or less, more preferably 1.5 μm or less.

The mean major axis of the dispersed phase of the lubricant in the bottom layer may be 0.1 μm or more, preferably 0.3 μm or more, more preferably 0.5 μm or more, and may be 2.0 μm or less, preferably 1.8 μm or less, more preferably 1.5 μm or less.

Across the entire resin coating, the mean major axis of the dispersed phase of the lubricant may be 0.5 μm or more and 2.0 μm or less, preferably 1.0 μm or more and 1.8 μm or less, more preferably 1.2 μm or more and 1.5 μm or less.

If the lubricant is a layered compound (e.g., melamine cyanurate), the mean major axis of the dispersed phase of the lubricant in each layer may be as follows.

The mean major axis of the dispersed phase of the lubricant in the top layer may be 0.05 μm or more, preferably 0.1 μm or more, more preferably 0.3 μm or more, and may be 1.5 μm or less, preferably 1.2 μm or less, more preferably 1.0 μm or less.

The mean major axis of the dispersed phase of the lubricant in the middle layer may be 0.05 μm or more, preferably 0.1 μm or more, more preferably 0.3 μm or more, and may be 1.5 μm or less, preferably 1.2 μm or less, more preferably 1.0 μm or less.

The mean major axis of the dispersed phase of the lubricant in the bottom layer may be 0.05 μm or more, preferably 0.1 μm or more, more preferably 0.3 μm or more, and may be 1.5 μm or less, preferably 1.0 μm or less, more preferably 0.8 μm or less.

Across the entire resin coating, the mean major axis of the dispersed phase of the lubricant may be 0.3 μm or more and 1.5 μm or less, preferably 0.4 μm or more and 1.2 μm or less, more preferably 0.5 μm or more and 1.0 μm or less.

The ratio between the mean major axis of the dispersed phase of the lubricant in the top layer and that in the middle layer (top layer/middle layer) may be 1.0 or more and 2.0 or less, preferably 1.0 or more and 1.5 or less, more preferably 1.2 or more and 1.5 or less.

Across the entire resin coating, the mean aspect ratio (major axis/minor axis) of the dispersed phase of the lubricant may be 1.2 or more and 2.5 or less, preferably 1.2 or more and 1.8 or less, more preferably 1.2 or more and 1.5 or less.

The average thickness of the resin coating may be 0.1 μm or more, preferably 0.3 μm or more, more preferably 1 μm or more, even more preferably 2 μm or more, still more preferably 3 μm or more, and may be 10 μm or less, preferably 8 μm or less, more preferably 5 μm or less.

The following describes the individual components of the carrier according to this exemplary embodiment in detail.

Magnetic Particles

The magnetic particles may be of any known type of magnetic particles that are used as a core material for a carrier. Specific examples of magnetic particles include particles of magnetic metals, such as iron, nickel, and cobalt; particles of magnetic oxides, such as ferrite and magnetite;

resin-impregnated magnetic particles, which are made by impregnating a porous magnetic powder with resin; and magnetic powder-dispersed resin particles, which are made by dispersing and mixing magnetic particles in resin. In this exemplary embodiment, ferrite particles are preferred.

The volume-average diameter of the magnetic particles may be 15 μm or more and 100 μm or less, preferably 20 μm or more and 80 μm or less, more preferably 30 μm or more and 60 μm or less. The volume-average diameter in this context refers to the particle diameter D50v, the particle diameter in the size distribution of the particles on a volume basis at which the cumulative volume of particles from the smallest diameter is 50%.

As for the magnetic force of the magnetic particles, the saturation magnetization in a magnetic field of 3000 Oersteds may be 50 emu/g or more, preferably 60 emu/g or more. This saturation magnetization is measured using VSMP10-15 vibrating sample magnetometer (Toei Industry). The sample for measurement is loaded into a cell measuring 7 mm in inner diameter and 5 mm in height, and this cell is set in the magnetometer. A magnetic field is applied to the sample and gradually increased up to 3000 Oersteds. The magnetic field applied is then reduced to draw a hysteresis loop on chart paper. The saturation magnetization, remanent magnetization, and coercivity are determined from data from the loop.

The electrical volume resistance (volume resistivity) of the magnetic particles may be $1\times10^5$ Ω·cm or more and $1\times10^9$ Ω·cm or less, preferably $1\times10^7$ Ω·cm or more and $1\times10^9$ Ω·cm or less.

The measurement of the electrical volume resistance (Ω·cm) of the magnetic particles is as follows. On the surface of a round jig having 20-$cm^2$ plate electrodes, the subject of measurement is spread to form a flat layer with a thickness of 1 mm or more and 3 mm or less. A 20-$cm^2$ plate electrode is placed on this layer to sandwich the layer between the electrodes. A load of 4 kg is placed on the upper electrode to eliminate the space between the subject and the electrode, and then the thickness of the layer (cm) is measured. The two electrodes, on and below the layer, have been connected to an electrometer and a high-voltage power supply. A high voltage is applied to the electrodes to produce an electric field of 103.8 V/cm, and the current reading (A) is recorded. The measurement is performed under the conditions of a temperature of 20° C. and a humidity of 50%, and the electrical volume resistance (Ω·cm) of the subject is calculated in accordance with the following equation.

$$R=E\times20/(I-I_0)/L$$

In the equation, R represents the electrical volume resistance (Ω·cm) of the subject, E represents the voltage applied (V), I represents electrical current (A), $I_0$ represents the electrical current (A) at an applied voltage of 0 V, and L represents the thickness (cm) of the layer. The coefficient 20 is the area ($cm^2$) of the plate electrodes.

Resin Coating

Examples of resins for the resin coating include styrene-acrylic acid copolymers; polyolefin resins, such as polyethylene and polypropylene; polyvinyl or polyvinylidene resins, such as polystyrene, acrylic resins, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymers; straight silicone resins, formed by organosiloxane bonds, or their modified forms; fluoropolymers, such as polytetrafluoroethylene, polyvinyl fluoride, polyvinylidene fluoride, and polychlorotrifluoroethylene; polyesters; polycarbonates; amino resins, such as urea-formaldehyde resins; and epoxy resins.

The resin coating may contain an alicyclic (meth)acrylic resin. The alicyclic (meth)acrylic resin may be polymerized from a lower-alkyl ester of (meth)acrylic acid (e.g., an alkyl ester of (meth)acrylic acid with a C1-9 alkyl group), and specific examples of such esters include methyl (meth) acrylate, ethyl (meth)acrylate, propyl (meth)acrylate, butyl (meth)acrylate, hexyl (meth)acrylate, cyclohexyl (meth) acrylate, and 2-ethylhexyl (meth)acrylate. One such monomer may be used alone, or two or more may be used in combination.

Preferably, the alicyclic (meth)acrylic resin is polymerized from monomers including cyclohexyl (meth)acrylate. The cyclohexyl (meth)acrylate content of the alicyclic (meth)acrylic resin may be 75% by mass or more and 100% by mass or less, preferably 85% by mass or more and 100% by mass or less, more preferably 95% by mass or more and 100% by mass or less of the total mass of the alicyclic (meth)acrylic resin.

Examples of lubricants that may be contained in the resin coating include metal salts of fatty acids and layered compounds.

Examples of metal salts of fatty acids include metal salts of stearic acid and metal salts of lauric acid. Examples of metal salts of stearic acid include zinc stearate, calcium stearate, barium stearate, magnesium stearate, aluminum stearate, lithium stearate, potassium stearate, and iron stearate. Examples of metal salts of lauric acid include zinc laurate, calcium laurate, barium laurate, magnesium laurate, aluminum laurate, lithium laurate, potassium laurate, and iron laurate.

Layered compounds, having a layered structure with an interlayer distance on the order of Angstroms, are considered to provide lubrication through relative displacement between layers. Examples of layered compounds include melamine cyanurate, boron nitride, fluorinated graphite, molybdenum disulfide, and mica.

The resin coating may contain inorganic or organic particles. Examples of inorganic particles include particles of metal oxides, such as silica, titanium oxide, zinc oxide, and tin oxide; particles of metal compounds, such as barium sulfate, aluminum borate, and potassium titanate; and particles of metals, such as gold, silver, and copper. Examples of organic particles include particles of polymethyl methacrylate (PMMA).

Inorganic particles may have a hydrophobic surface created by hydrophobization. Examples of hydrophobizing agents include known organic silicon compounds having an alkyl group (e.g., the methyl, ethyl, propyl, or butyl group), specifically alkoxysilane compounds, siloxane compounds, and silazane compounds. One hydrophobizing agent may be used alone, or two or more may be used in combination.

The resin coating may contain electrically conductive particles for the control of charging and electrical resistance. Examples of electrically conductive particles include carbon black and inorganic particles (examples listed above) that are electrically conductive.

The formation of the resin coating on the surface of the magnetic particles is by, for example, a wet process or dry process. In wet processes, the resin for the resin coating is dissolved or dispersed in solvent. In dry processes, no solvent is used.

Examples of wet processes include dipping, in which the magnetic particles are immersed in a resin liquid; spraying, in which a resin liquid is sprayed onto the surface of the magnetic particles; fluidized bed coating, in which a resin liquid is sprayed onto magnetic particles floated on a stream of air; and kneader-coater coating, in which the magnetic particles and a resin liquid are mixed in a kneader-coater, and then the solvent is removed. One of such processes may be repeated, and two or more such processes may be combined.

In wet processes, the resin, inorganic particles, and other ingredients are dissolved or dispersed in solvent to give a resin liquid for the formation of the resin coating. The solvent may be of any kind. Examples include aromatic hydrocarbons, such as toluene and xylene; ketones, such as acetone and methyl ethyl ketone; and ethers, such as tetrahydrofuran and dioxane.

As for dry processes for the formation of the resin coating, an example is to attach the resin and the lubricant to a dry surface of the magnetic particles. The attachment of the resin and the lubricant to the surface of the magnetic particles may be through, for example, the use of a dry-particle composing machine (e.g., Hosokawa Micron's Nobilta).

To control the percentage, size, and aspect ratio of the dispersed phase of the lubricant in the top, middle, and bottom layers of the resin coating, a possible way is to produce the three layers of the resin coating separately. In the formation of each layer, the amount, size, and shape of the lubricant particles used are adjusted. If a dry-particle composing machine (e.g., Hosokawa Micron's Nobilta) is used, the shape and aspect ratio of portions of the dispersed phase may be controlled by adjusting the shear force applied to the materials.

The percentage exposed area of the magnetic particles on the surface of the carrier may be 0% or more and 5% or less. The percentage exposed area of the magnetic particles in the carrier may be controlled by changing the amount of resin used to form the resin coating. The percentage exposed area decreases with increasing amount of resin relative to the amount of the magnetic particles.

The percentage exposed area of the magnetic particles on the surface of the carrier is determined as follows.

Bare magnetic particles are prepared by removing the resin coating from the carrier of interest, for example by dissolving the resin component in an organic solvent or heating the carrier at approximately 800° C. to eliminate the resin component. The concentration of Fe (atomic %) on the surface of the carrier and that on the surface of the bare magnetic particles are measured by x-ray photoelectron spectroscopy (XPS). (The concentration of Fe in the carrier)/(the concentration of Fe in the magnetic particles)×100 is the percentage exposed area (%) of the magnetic particles.

The volume-average diameter of particles in the carrier may be 10 μm or more and 120 μm or less, preferably 20 μm or more and 100 μm or less, more preferably 30 μm or more and 80 μm or less. The volume-average diameter in this context refers to the particle diameter D50v, the particle diameter in the size distribution of the particles on a volume basis at which the cumulative volume of particles from the smallest diameter is 50%.

Electrostatic Charge Image Developer

A developer according to an exemplary embodiment is a two-component developer that contains a carrier according to the above exemplary embodiment and toner. The toner contains toner particles and optionally external additives.

The ratio (by mass) in which the carrier and the toner are mixed in the developer may be between 100:1 (carrier:toner) and 100:30, preferably between 100:3 and 100:20.

Toner Particles

The toner particles contain, for example, a binder resin, optionally with a coloring agent, a release agent, and/or other additives.

Binder Resin

Examples of binder resins include vinyl resins that are homopolymers of monomers such as styrenes (e.g., styrene, para-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene) or copolymers of two or more such monomers.

Non-vinyl resins, such as epoxy resins, polyester resins, polyurethane resins, polyamide resins, cellulose resins, polyether resins, and modified rosin, mixtures of any such resin and vinyl resin(s), and graft copolymers obtained by polymerizing a vinyl monomer in the presence of any such non-vinyl resin may also be used.

One such binder resin may be used alone, or two or more may be used in combination.

Polyester resins may be used as binder resins.

Examples of polyester resins include known amorphous polyester resins. A combination of amorphous and crystalline polyester resins may also be used. In that case, the percentage of the crystalline polyester resin may be 2% by mass or more and 40% by mass or less (preferably 2% by mass or more and 20% by mass or less) of all binder resins.

It should be noted that if a resin is "crystalline" herein, it means that the endothermic profile of the resin as measured by differential scanning calorimetry (DSC) is not stepwise but has a clear peak, specifically a peak with a half width of 10° C. or narrower in DSC performed at a temperature elevation rate of 10 (° C./min).

The endothermic profile of an "amorphous" resin by DSC, by contrast, is stepwise or has no clear peak, or has a peak with a half width boarder than 10° C. under the same conditions.

Amorphous Polyester Resin

An example of an amorphous polyester resin is a polycondensate of a polycarboxylic acid and a polyhydric alcohol. An amorphous polyester resin may be a commercially available one or may be a synthesized one.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides or lower-alkyl (e.g., C1-5 alkyl) esters of such acids. Aromatic dicarboxylic acids, for example, are preferred.

A dicarboxylic acid may be used in combination with a crosslinked or branched carboxylic acid having three or more carboxylic groups. Examples of carboxylic acids having three or more carboxylic groups include trimellitic acid, pyromellitic acid, and anhydrides or lower-alkyl (e.g., C1-5 alkyl) esters of these acids.

One polycarboxylic acid may be used alone, or two or more may be used in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Aromatic diols and alicyclic diols, for example, are preferred, and aromatic diols are more preferred.

A diol may be used in combination with a crosslinked or branched polyhydric alcohol having three or more hydroxyl groups. Examples of polyhydric alcohols having three or more hydroxyl groups include glycerol, trimethylolpropane, and pentaerythritol.

One polyhydric alcohol may be used alone, or two or more may be used in combination.

The glass transition temperature (Tg) of the amorphous polyester resin may be 50° C. or more and 80° C. or less, preferably 50° C. or more and 65° C. or less.

This glass transition temperature is determined from the DSC curve of the resin, which is measured by differential scanning calorimetry (DSC), or more specifically is the "extrapolated initial temperature of glass transition" as in the methods for determining glass transition temperatures set forth in JIS K7121: 1987 "Testing Methods for Transition Temperatures of Plastics."

The weight-average molecular weight (Mw) of the amorphous polyester resin may be 5000 or more and 1000000 or less, preferably 7000 or more and 500000 or less.

The number-average molecular weight (Mn) of the amorphous polyester resin may be 2000 or more and 100000 or less.

The molecular weight distribution, Mw/Mn, of the amorphous polyester resin may be 1.5 or more and 100 or less, preferably 2 or more and 60 or less.

These weight- and number-average molecular weights are measured by gel permeation chromatography (GPC). The analyzer is Tosoh's HLC-8120 GPC chromatograph with Tosoh's TSKgel SuperHM-M column (15 cm), and the eluate is tetrahydrofuran (THF). Comparing the measurements with a molecular-weight calibration curve prepared using monodisperse polystyrene standards gives the weight- and number-average molecular weights.

The production of the amorphous polyester resin may be by a known method. A specific example is to polymerize raw materials at a temperature of 180° C. or more and 230° C. or less. The reaction system may optionally be evacuated to remove the water and alcohol that are produced as condensation proceeds.

If the raw-material monomers do not dissolve or are not miscible together at the reaction temperature, a solvent having a high boiling point may be added as a solubilizer to make the monomers dissolve. In that case, the solubilizer is removed by distillation during the polycondensation. Any monomer not miscible with the other(s) may be condensed with the planned counterpart acid(s) or alcohol(s) before the polycondensation process.

Crystalline Polyester Resin

An example of a crystalline polyester resin is a polycondensate of a polycarboxylic acid and a polyhydric alcohol. A crystalline polyester resin may be a commercially available one or may be a synthesized one.

The crystalline polyester resin may be a polycondensate made with linear aliphatic polymerizable monomers rather than aromatic ones. This helps the resin form its crystal structure.

Examples of polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids, such as phthalic acid, isophthalic acid, terephthalic acid, and naphthalene-2,6-dicarboxylic acid), and anhydrides or lower-alkyl (e.g., C1-5 alkyl) esters of such acids.

A dicarboxylic acid may be used in combination with a crosslinked or branched carboxylic acid having three or more carboxylic groups. Examples of carboxylic acids having three or more carboxylic groups include aromatic carboxylic acids (e.g., 1,2,3-benzenetricarboxylic acid, 1,2,4-benzenetricarboxylic acid, and 1,2,4-naphthalenetricarboxylic acid) and anhydrides or lower-alkyl (e.g., C1-5 alkyl) esters of such acids.

A dicarboxylic acid such as listed above may be used in combination with a dicarboxylic acid having a sulfonic acid group and/or a dicarboxylic acid having an ethylenic double bond.

One polycarboxylic acid may be used alone, or two or more may be used in combination.

Examples of polyhydric alcohols include aliphatic diols (e.g., C7-20 linear aliphatic diols). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. 1,8-Octanediol, 1,9-nonanediol, and 1,10-decanediol are preferred.

A diol may be used in combination with a crosslinked or branched alcohol having three or more hydroxyl groups. Examples of alcohols having three or more hydroxyl groups include glycerol, trimethylolethane, trimethylolpropane, and pentaerythritol.

One polyhydric alcohol may be used alone, or two or more may be used in combination.

The percentage of aliphatic diols in the polyhydric alcohol(s) may be 80 mol % or more, preferably 90 mol % or more.

The melting temperature of the crystalline polyester resin may be 50° C. or more and 100° C. or less, preferably 55° C. or more and 90° C. or less, more preferably 60° C. or more and 85° C. or less.

This melting temperature is the "peak melting temperature" of the resin as in the methods for determining melting temperatures set forth in JIS K7121: 1987 "Testing Methods for Transition Temperatures of Plastics" and is determined from the DSC curve of the resin, which is measured by differential scanning calorimetry (DSC).

The weight-average molecular weight (Mw) of the crystalline polyester resin may be 6,000 or more and 35,000 or less.

The production of the crystalline polyester resin may be by a known method. For example, the crystalline polyester resin may be produced in the same way as the amorphous polyester resin.

The binder resin content may be 40% by mass or more and 95% by mass or less, preferably 50% by mass or more and 90% by mass or less, more preferably 60% by mass or more and 85% by mass or less of the toner particles as a whole.

Coloring Agent

Examples of coloring agents include pigments, such as carbon black, chrome yellow, Hansa yellow, benzidine yellow, threne yellow, quinoline yellow, pigment yellow, permanent orange GTR, pyrazolone orange, Vulcan orange, Watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, Calco oil blue, methylene blue chloride, phthalocyanine blue, pigment blue, phthalocyanine green, and malachite green oxalate; and dyes, such as acridine, xanthene, azo, benzoquinone, azine, anthraquinone, thioindigo, dioxazine, thiazine, azomethine, indigo, phthalocyanine, aniline black, polymethine, triphenylmethane, diphenylmethane, and thiazole dyes.

One coloring agent may be used alone, or two or more may be used in combination.

The coloring agent(s) may optionally be surface-treated, or may be used in combination with a dispersant. Multiple coloring agents may be used.

The coloring agent content may be 1% by mass or more and 30% by mass or less, preferably 3% by mass or more and 15% by mass or less, of the toner particles as a whole.

Release Agent

Examples of release agents include hydrocarbon waxes; natural waxes, such as carnauba wax, rice wax, and candelilla wax; synthesized or mineral/petroleum waxes, such as montan wax; and ester waxes, such as fatty acid esters and montanates. Other release agents may also be used.

The melting temperature of the release agent may be 50° C. or more and 110° C. or less, preferably 60° C. or more and 100° C. or less.

This melting temperature is the "peak melting temperature" of the release agent as in the methods for determining melting temperatures set forth in JIS K7121: 1987 "Testing Methods for Transition Temperatures of Plastics" and is determined from the DSC curve of the release agent, which is measured by differential scanning calorimetry (DSC).

The release agent content may be 1% by mass or more and 20% by mass or less, preferably 5% by mass or less and 15% by mass or less, of the toner particles as a whole.

Other Additives

Examples of other additives include known additives, such as magnetic substances, charge control agents, and inorganic powders. Such additives, if used, are contained in the toner particles as internal additives.

Characteristics and Other Details of the Toner Particles

The toner particles may be single-layer toner particles or may be so-called core-shell toner particles, i.e., toner particles formed by a core section (core particle) and a coating layer that covers the core section (shell layer).

Core-shell toner particles may be formed by, for example, a core section made with a binder resin and optionally additives, such as a coloring agent and/or a release agent, and a coating layer made with a binder resin.

The volume-average diameter (D50v) of the toner particles may be 2 μm or more and 10 μm or less, preferably 4 μm or more and 8 μm or less.

The volume-average diameter (D50v) of the toner particles is measured using a Coulter Multisizer II (Beckman Coulter) and an ISOTON-II electrolyte (Beckman Coulter).

Specifically, 0.5 mg or more and 50 mg or less of the toner particles as a sample for measurement is added to 2 ml of a 5% by mass aqueous solution of a surfactant (e.g., a sodium alkylbenzene sulfonate) as a dispersant. The resulting dispersion is added to 100 ml or more and 150 ml or less of the electrolyte.

The electrolyte with the sample suspended therein is sonicated for 1 minute using a sonicator. Using Coulter Multisizer II with an aperture size of 100 μm, the size distribution of 50000 sampled particles between 2 μm and 60 μm (diameter) is measured. The particle size distribution by volume is plotted, starting from the smallest diameter. The particle diameter at which the cumulative volume is 50% is the volume-average diameter D50v.

The average roundness of the toner particles may be 0.94 or more and 1.00 or less, preferably 0.95 or more and 0.98 or less.

The average roundness of the toner particles is given by (circumference of the equivalent circle)/(circumference) [(circumference of circles having the same projected area as particle images)/(circumference of projected images of the particles)]. Specifically, it is a value measured as follows.

First, a portion of the toner particles of interest is collected by aspiration to form a flat stream. This flat stream is photographed with a flash to capture the figures of the particles in a still image. The images of 3500 sampled particles are analyzed using a flow particle-image analyzer (Sysmex FPIA-3000), and the average roundness is determined from the results.

If the toner contains external additives, the external additives are removed beforehand by dispersing the toner (developer) in water containing a surfactant and sonicating the resulting dispersion.

Production of the Toner Particles

The production of the toner particles may be by a dry process (e.g., kneading and milling) or wet process (e.g., aggregation and coalescence, suspension polymerization, or dissolution and suspension). Any known dry or wet process may be used. Preferably, the toner particles are obtained by aggregation and coalescence.

Specifically, if the toner particles are produced by, for example, aggregation and coalescence, the process includes preparing a liquid dispersion of the resin particles that will serve as a binder resin (preparation of a liquid dispersion of resin particles), allowing the resin particles (and optionally other kind(s) of particles) to form aggregates in the liquid dispersion (or a liquid dispersion prepared by mixing with other liquid dispersion(s) of particles) (formation of aggregates), and heating the resulting liquid dispersion of aggregates to make the aggregates fuse and coalesce together, thereby forming toner particles (fusion and coalescence).

In the following, this process is described in detail.

It should be noted that the method described below gives toner particles that contain a coloring agent and a release agent, but the coloring agent and the release agent are optional. Naturally, additives other than a coloring agent and a release agent may also be used.

Preparation of a Liquid Dispersion of Resin Particles

First, a liquid dispersion of the resin particles that will serve as a binder resin is prepared. A liquid dispersion of coloring-agent particles and a liquid dispersion of release-agent particles, for example, are also prepared.

The preparation of the liquid dispersion of resin particles is by, for example, dispersing the resin particles in a dispersion medium using a surfactant.

An example of a dispersion medium for the liquid dispersion of resin particles is an aqueous medium.

Examples of aqueous media include types of water, such as distilled water and deionized water, and alcohols. One such dispersion medium may be used alone, or two or more may be used in combination.

Examples of surfactants include anionic surfactants, such as sulfates, sulfonates, phosphates, and soap surfactants;

cationic surfactants, such as amine salts and quaternary ammonium salts; and nonionic surfactants, such as polyethylene glycol surfactants, ethylene oxide adducts of alkylphenols, and polyhydric alcohols. Anionic surfactants and cationic surfactants are preferred. Nonionic surfactants may be used in combination with an anionic or cationic surfactant.

One surfactant may be used alone, or two or more may be used in combination.

In the preparation of the liquid dispersion of resin particles, the resin particles may be dispersed in the dispersion medium by a commonly used dispersion technique, such as a rotary-shear homogenizer or a medium mill, e.g., a ball mill, sand mill, or Dyno-Mill. For certain types of resin particles, phase inversion emulsification may be used. Phase inversion emulsification is a technique in which the resin to be dispersed is dissolved in a hydrophobic organic solvent in which the resin is soluble, the resulting organic continuous phase (O phase) is neutralized with a base, and then an aqueous medium (W phase) is added to invert the phases from W/O to O/W, thereby dispersing particles of the resin in the aqueous medium.

The volume-average diameter of the resin particles to be dispersed in the liquid dispersion may be, for example, 0.01 μm or more and 1 μm or less, preferably 0.08 μm or more and 0.8 μm or less, more preferably 0.1 μm or more and 0.6 μm or less.

The volume-average diameter of the resin particles is measured as follows. That is, the size distribution of the particles is measured using a laser-diffraction particle size distribution analyzer (e.g., HORIBA LA-700). The measured distribution is divided into segments by particle size (channels), and the cumulative distribution of volume is plotted starting from the smallest diameter. The particle diameter at which the cumulative volume is 50% of the total volume of the particles is the volume-average diameter D50v of the particles. For the other liquid dispersions, too, the measurement of the volume-average diameter of particles therein is the same.

The resin particle content of the liquid dispersion of resin particles may be 5% by mass or more and 50% by mass or less, preferably 10% by mass or more and 40% by mass or less.

The liquid dispersion of coloring-agent particles and that of release-agent particles, for example, are also prepared in the same way as the liquid dispersion of resin particles. The above description about the volume-average diameter of particles, dispersion medium, how to disperse the particles, and the particle content for the liquid dispersion of resin particles therefore also applies to the coloring-agent particles and the release-agent particles in their respective liquid dispersions.

Formation of Aggregates

Then, the liquid dispersion of resin particles is mixed with the liquid dispersion of coloring-agent particles and the liquid dispersion of release-agent particles.

In the mixture of liquid dispersions, the resin particles, the coloring-agent particles, and the release-agent particles are allowed to aggregate together. This process of heteroaggregation is continued until aggregates of the resin particles, the coloring-agent particles, and the release-agent particles grow to a diameter close to the planned diameter of the toner particles.

Specifically, for example, a flocculant is added to the mixture of liquid dispersions. The pH of the mixture is adjusted to an acidic level (e.g., a pH of 2 or more and 5 or less), optionally followed by the addition of a dispersion stabilizer. The mixture of liquid dispersions is then heated to a temperature close to the glass transition temperature of the resin particles (specifically, for example, a temperature higher than or equal to the glass transition temperature the resin particles—30° C. but not higher than the glass transition temperature of the resin particles—10° C.). This makes the particles dispersed in the mixture form aggregates.

In the formation of aggregates, for example, the mixture of liquid dispersions may be stirred using a rotary-shear homogenizer, and the flocculant may be added at room temperature (e.g., 25° C.) with the mixture stirred. Then the pH of the mixture is adjusted to an acidic level (e.g., a pH of 2 or more and 5 or less), optionally followed by the addition of a dispersion stabilizer, and the mixture is heated as described above.

Examples of flocculants include surfactants that have the opposite polarity to the surfactant(s) contained in the mixture of liquid dispersions, inorganic metal salts, and metal complexes having a valency of 2 or more. The use of a metal complex as a flocculant improves charging characteristics because less surfactant is used in that case.

Optionally, an additive that forms a complex or similar bond with metal ions from the flocculant may be used. An example is a chelating agent.

Examples of inorganic metal salts include metal salts, such as calcium chloride, calcium nitrate, barium chloride, magnesium chloride, zinc chloride, aluminum chloride, and aluminum sulfate; and polymers of inorganic metal salts, such as polyaluminum chloride, polyaluminum hydroxide, and calcium polysulfide.

The chelating agent may be a water-soluble one. Examples of chelating agents include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of chelating agent added may be 0.01 parts by mass or more and 5.0 parts by mass or less, preferably 0.1 parts by mass or more and less than 3.0 parts by mass, per 100 parts by mass of the resin particles.

Fusion and Coalescence

Then, the aggregates are caused to fuse and coalesce together to form toner particles, for example by heating the liquid dispersion of aggregates to a temperature equal to or higher than the glass transition temperature of the resin particles (e.g., 10° C. to 30° C. higher than the glass transition temperature of the resin particles).

In this way, the toner particles are obtained.

Alternatively, the liquid dispersion of aggregates prepared may be mixed with another volume of the liquid dispersion of resin particles. The aggregates and the resin particles are caused to aggregate together in such a manner that additional resin particles will adhere to the surface of the aggregates, forming a second form of aggregates. The liquid dispersion of the second form of aggregates is heated to make the second form of aggregates fuse and coalesce together to form core/shell toner particles.

After the end of fusion and coalescence, the toner particles, formed in a solution, are washed, separated from the solution, and dried by known methods to give dry toner particles. The washing may be by sufficient replacement with deionized water in view of chargeability. The separation from the solution may be by suction filtration, pressure filtration, etc., in view of productivity. The drying may be by lyophilization, flash drying, fluidized drying, vibrating fluidized drying, etc., in view of productivity.

The toner according to this exemplary embodiment is then produced, for example by adding external additives to the dry toner particles and mixing them. The mixing may be through the use of, for example, a V-blender, Henschel mixer, or Lödige mixer. Optionally, coarse particles may be removed from the developer, for example using a vibrating sieve or air-jet sieve.

External Additives

An example of an external additive is inorganic particles. Examples of inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

As an external additive, inorganic particles may have a hydrophobic surface created by hydrophobization, for example by immersion in a hydrophobizing agent. The hydrophobizing agent may be of any kind, but examples include silane coupling agents, silicone oil, titanate coupling agents, and aluminum coupling agents. One such agent may be used alone, or two or more may be used in combination.

The amount of hydrophobizing agent is usually, for example, 1 part by mass or more and 10 parts by mass or less per 100 parts by mass of the inorganic particles.

Materials like resin particles (particles of polystyrene, polymethyl methacrylate, melamine resins, etc.) and active cleaning agents (e.g., metal salts of higher fatty acids, typically zinc stearate, and particles of fluoropolymers) are also examples of external additives.

The percentage of external additives may be 0.01% by mass or more and 5% by mass or less, preferably 0.01% by mass or less and 2.0% by mass or less, of the toner particles.

Image Forming Apparatus and Image Forming Method

An image forming apparatus according to an exemplary embodiment includes an image carrier; a charging component that charges the surface of the image carrier; an electrostatic charge image creating component that creates an electrostatic charge image on the charged surface of the image carrier; a developing component that contains an electrostatic charge image developer and develops, using the electrostatic charge image developer, the electrostatic charge image created on the surface of the image carrier to form a toner image; a transfer component that transfers the toner image on the surface of the image carrier to the surface of a recording medium; and a fixing component that fixes the toner image on the surface of the recording medium. The electrostatic charge image developer is an electrostatic charge developer according to the above exemplary embodiment.

The image forming apparatus according to this exemplary embodiment performs an image forming method (image forming method according to an exemplary embodiment) that includes charging the surface of an image carrier; creating an electrostatic charge image on the charged surface of the image carrier; developing, using an electrostatic charge image developer according to the above exemplary embodiment, the electrostatic charge image created on the surface of the image carrier to form a toner image; transferring the toner image on the surface of the image carrier to the surface of a recording medium; and fixing the toner image on the surface of the recording medium.

The configuration of the image forming apparatus according to this exemplary embodiment is applied to known types of image forming apparatuses.

Examples include direct-transfer apparatuses, which transfer a toner image formed on the surface of an image carrier directly to a recording medium; intermediate-transfer apparatuses, which transfer a toner image formed on the surface of an image carrier to the surface of an intermediate transfer body (first transfer), and then transfer the toner image on the surface of the intermediate transfer body to the surface of a recording medium (second transfer); apparatuses that include a cleaning component that cleans the surface of the image carrier between the transfer of the toner image and charging; and apparatuses that have a static eliminator, which removes static electricity from the surface of the image carrier by irradiating the surface with antistatic light between the transfer of the toner image and charging.

If the image forming apparatus according to this exemplary embodiment is made as an intermediate-transfer apparatus, the transfer component includes, for example, an intermediate transfer body, a first transfer component, and a second transfer component. The toner image formed on the surface of the image carrier is transferred to the surface of the intermediate transfer body by the first transfer component (first transfer), and then the toner image on the surface of the intermediate transfer body is transferred to the surface of a recording medium by the second transfer component (second transfer).

Part of the image forming apparatus according to this exemplary embodiment, e.g., a portion including the developing component, may have a cartridge structure, i.e., a structure that allows the part to be attached to and detached from the image forming apparatus (or may be a process cartridge). An example of a process cartridge is one that contains the electrostatic charge image developer according to the above exemplary embodiment and includes the developing component.

The following describes an example of an image forming apparatus according to this exemplary embodiment. It should be noted that the image forming apparatus according to this exemplary embodiment is not limited to this example. The following description is focused on structural elements illustrated in a drawing.

Figure 4:
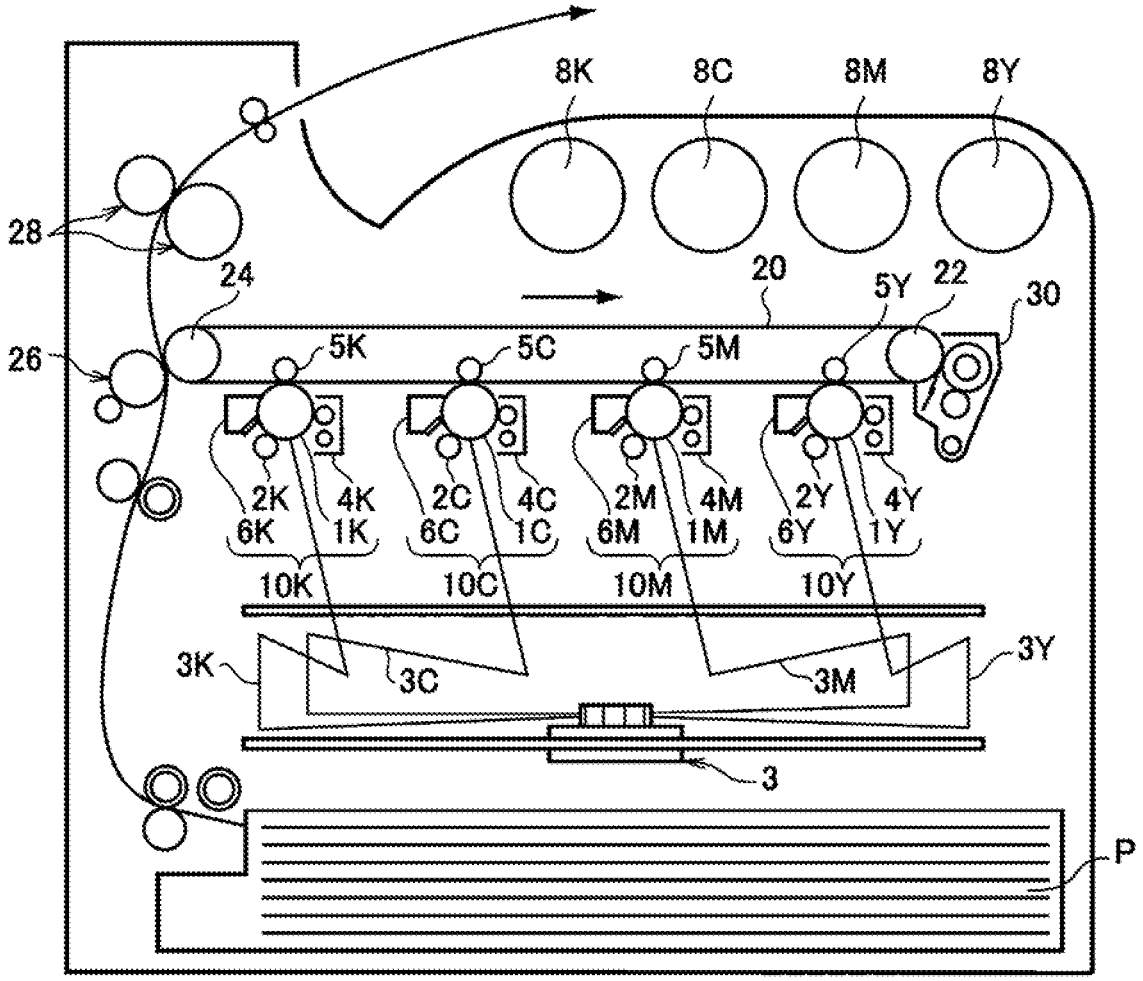
FIG. 4 schematically illustrates the structure of an example of an image forming apparatus according to an exemplary embodiment.

FIG. 4 schematically illustrates the structure of an image forming apparatus according to this exemplary embodiment.

The image forming apparatus illustrated in FIG. 4 includes first to fourth electrophotographic image forming units 10Y, 10M, 10C, and 10K (image forming component) that produce images in the colors of yellow (Y), magenta (M), cyan (C), and black (K), respectively, based on color-separated image data. The image forming units (hereinafter also referred to simply as "units") 10Y, 10M, 10C, and 10K are arranged in a horizontal row with a predetermined distance therebetween. The units 10Y, 10M, 10C, and 10K may be process cartridges, i.e., units that are attached to and detached from the image forming apparatus.

Above the units 10Y, 10M, 10C, and 10K is an intermediate transfer belt (example of an intermediate transfer body) 20, which also extends through each of the units. The intermediate transfer belt 20 is wound over a drive roller 22 and a support roller 24 and runs in the direction from the first unit 10Y to the fourth unit 10K. A spring or similar mechanism, not illustrated, applies force to the support roller 24 in the direction away from the drive roller 22, placing tension on the intermediate transfer belt 20 wound over the two rollers. On the image carrier side of the intermediate transfer belt 20 is a cleaning device 30 for the intermediate transfer belt 20, facing the drive roller 22.

The developing devices (example of a developing component) 4Y, 4M, 4C, and 4K of the units 10Y, 10M, 10C, and 10K are supplied with toners in yellow, magenta, cyan, and black, respectively, contained in toner cartridges 8Y, 8M, 8C, and 8K.

The first to fourth units 10Y, 10M, 10C, and 10K are equivalent in structure and operation. In the following, the first unit 10Y, which is located upstream of the others in the direction of running of the intermediate transfer belt 20 and forms a yellow image, is described to represent the four units.

The first unit 10Y has a photoreceptor 1Y that operates as an image carrier. Around the photoreceptor 1Y are a charging roller (example of a charging component) 2Y that charges the surface of the photoreceptor 1Y to a predetermined potential; an exposure device (example of an electrostatic charge image creating component) 3 that irradiates the charged surface with a laser beam 3Y based on a color-separated image signal to create an electrostatic charge image there; a developing device (example of a developing component) 4Y that supplies charged toner to the electrostatic charge image to develop the electrostatic charge image; a first transfer roller (example of a first transfer component) 5Y that transfers the developed toner image to the intermediate transfer belt 20; and a photoreceptor cleaning device (example of a cleaning component) 6Y that removes residual toner off the surface of the photoreceptor 1Y after the first transfer, arranged in this order.

The first transfer roller 5Y is inside the intermediate transfer belt 20 and faces the photoreceptor 1Y. The first transfer rollers 5Y, 5M, 5C, and 5K of the units are connected to bias power supplies (not illustrated), which apply a first transfer bias to the rollers. The bias power supplies change the value of the transfer bias they apply to the first transfer rollers under the control of a controller, not illustrated.

The following describes how the first unit 10Y operates to form a yellow image.

First, the charging roller 2Y charges the surface of the photoreceptor 1Y to a potential of −600 V to −800 V beforehand.

The photoreceptor 1Y is a stack of an electrically conductive (e.g., a volume resistivity at 20° C. of $1\times10^{-6}$ Ωcm or less) substrate and a photosensitive layer thereon. The photosensitive layer is highly resistant (has the typical resistance of resin) in its normal state, but when it is irradiated with a laser beam, the resistivity of the irradiated portion changes. Thus, the charged surface of the photoreceptor 1Y is irradiated with a pattern of a laser beam 3Y that the exposure device 3 emits on the basis of data for the yellow image sent from a controller, not illustrated. This creates an electrostatic charge image as a pattern for the yellow image on the surface of the photoreceptor 1Y.

The electrostatic charge image is an image created on the surface of the photoreceptor 1Y as a result of charging. Once the laser beam 3Y reduces the resistivity of the irradiated portion of the photosensitive layer, the charge on the surface of the photoreceptor 1Y flows away. The charge on the portion not irradiated with the laser beam 3Y stays. The resulting electrostatic charge image is therefore a so-called negative latent image.

As the photoreceptor 1Y rotates, the electrostatic charge image created on the photoreceptor 1Y moves to a predetermined development point. At the development point, the developing device 4Y develops the electrostatic charge image on the photoreceptor 1Y into a visible toner image.

Inside the developing device 4Y is an electrostatic charge image developer that contains, for example, at least yellow toner and a carrier. The yellow toner is on a developer roller (example of a developer carrier) and has been triboelectrically charged with the same polarity as the charge on the photoreceptor 1Y (negative) as a result of stirring inside the developing device 4Y. The surface of the photoreceptor 1Y passes through this developing device 4Y, during which the yellow toner electrostatically adheres to the uncharged, latent image portion of the surface of the photoreceptor 1Y, thereby developing the latent image. Then the photoreceptor 1Y, with a yellow toner image thereon, continues running at a predetermined speed to transport the developed toner image thereon to a predetermined first transfer point.

After the arrival of the yellow toner image on the photoreceptor 1Y at the first transfer point, a first transfer bias is applied to the first transfer roller 5Y. Electrostatic force directed from the photoreceptor 1Y to the first transfer roller 5Y acts on the toner image on the photoreceptor 1Y to transfer it to the intermediate transfer belt 20. The applied transfer bias has the (+) polarity, opposite the polarity of the toner (−), and its amount is controlled by a controller (not illustrated) to, for example, +10 μA for the first unit 10Y.

Residual toner on the photoreceptor 1Y is removed and collected at the photoreceptor cleaning device 6Y.

The first transfer biases applied to the first transfer rollers 5M, 5C, and 5K of the second, third, and fourth units 10M, 10C, and 10K are also controlled in the same was as that to the first unit 10Y.

The intermediate transfer belt 20 to which a yellow toner image has been transferred at the first unit 10Y in this way is then moved to pass through the second to fourth units 10M, 10C, and 10K sequentially. Toner images in the respective colors are overlaid, completing multilayer transfer.

After this multilayer transfer of toner images in four colors by passing through the first to fourth units, the intermediate transfer belt 20 reaches the second transfer section, formed by the intermediate transfer belt 20, the support roller 24 touching the inner surface of the intermediate transfer belt 20, and the second transfer roller (example of a second transfer component) 26 on the image-carrying side of the intermediate transfer belt 20. Recording paper (example of a recording medium) P is delivered to the point of contact between the second transfer roller 26 and the intermediate transfer belt 20 in a timed manner by a feeding mechanism, and a second transfer bias is applied to the support roller 24. The applied transfer bias has the (−) polarity, the same as the polarity of the toner (−). Electrostatic force directed from the intermediate transfer belt 20 to the recording paper P acts on the toner image on the intermediate transfer belt 20 to transfer it to the recording paper P. The amount of the second transfer bias is controlled; it is determined in accordance with the resistance detected by a resistance detector (not illustrated) that detects the resistance of the second transfer section.

Then the recording paper P is sent to the point of pressure contact (nip) between a pair of fixing rollers at a fixing device (example of a fixing component) 28. The toner image is fixed on the recording paper P, producing a fixed image.

Examples of types of recording paper P to which the toner image is transferred include ordinary printing paper for copiers, printers, etc., of electrophotographic type. In addition to recording paper P, overhead-projector (OHP) film is also an example of a recording medium.

For improved smoothness of the surface of the fixed image, the recording paper P may have a smooth surface. For example, coated paper, which is paper having a coated surface, for example a resin-coated surface, or art paper for printing purposes may be used.

After the completion of the fixation of the color image, the recording paper P is transported to an ejection section to finish the formation of a color image.

Process Cartridge

A process cartridge according to an exemplary embodiment includes a developing component that contains an electrostatic charge image developer according to an above exemplary embodiment and develops, using the electrostatic charge image developer, an electrostatic charge image created on the surface of an image carrier to form a toner image. The process cartridge is attached to and detached from an image forming apparatus.

The process cartridge according to this exemplary embodiment is not limited to this configuration. In addition to the developing component, it may optionally have, for example, at least one selected from other components like an image carrier, a charging component, an electrostatic charge image creating component, and a transfer component.

The following describes an example of a process cartridge according to this exemplary embodiment. It should be noted that the process cartridge according to this exemplary embodiment is not limited to this example. The following description is focused on structural elements illustrated in a drawing.

Figure 5:
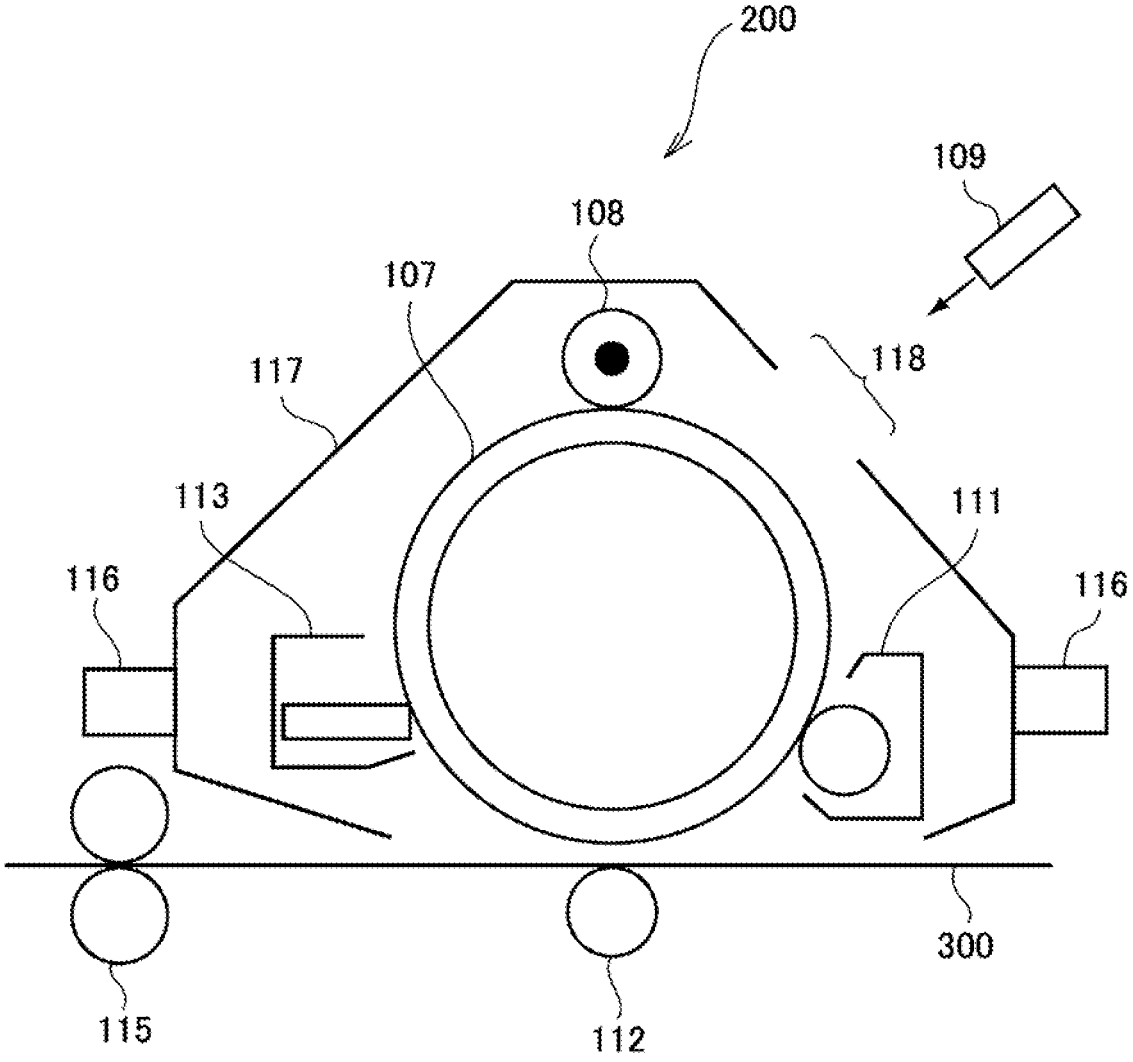
FIG. 5 schematically illustrates the structure of an example of a process cartridge according to an exemplary embodiment that is attached to and detached from an image forming apparatus.

FIG. 5 schematically illustrates the structure of a process cartridge according to this exemplary embodiment.

The process cartridge 200 illustrated in FIG. 5 is a cartridge made by, for example, holding a photoreceptor 107 (example of an image carrier) and its peripheral components together in a housing 117 that has attachment rails 116 and an opening 118 for exposure to light. The peripheral components are a charging roller 108 (example of a charging component), a developing device 111 (example of a developing component), and a photoreceptor-cleaning device 113 (example of a cleaning component).

FIG. 5 also includes an exposure device 109 (example of an electrostatic charge image creating component), a transfer device 112 (example of a transfer component), a fixing device 115 (example of a fixing component), and recording paper 300 (example of a recording medium).

EXAMPLES

The following describes exemplary embodiments of the present disclosure by providing examples, but the exemplary embodiments of the present disclosure are not limited to these Examples. In the following description, "parts" and "%" are by mass unless stated otherwise.

Production of Toner

Production of a Liquid Dispersion of an Amorphous Polyester Resin (A1)

Ethylene glycol: 37 parts
Neopentyl glycol: 65 parts
1,9-Nonanediol: 32 parts
Terephthalic acid: 96 parts These materials are loaded into a flask and heated to a temperature of 200° C. over 1 hour. After the reaction system has been stirred to uniformity, 1.2 parts of dibutyltin oxide is added. The temperature is increased to 240° C. over 6 hours while the water produced is removed by distillation, and stirring is continued for 4 hours at 240° C. This gives an amorphous polyester resin (acid value, 9.4 mg KOH/g; weight-average molecular weight, 13,000; glass transition temperature, 62° C.). The molten amorphous polyester resin is transferred to an emulsifying and dispersing machine (Cavitron CD1010, Eurotec) at a speed of 100 g per minute. Separately, reagent-grade aqueous ammonia is diluted with deionized water to a concentration of 0.37%. The resulting dilute aqueous ammonia is put into a tank and then, simultaneously with the amorphous polyester resin, transferred to the emulsifying and dispersing machine at a speed of 0.1 liters per minute while being heated to 120° C. in a heat exchanger. The emulsifying and dispersing machine is operated at a rotor speed of 60 Hz and a pressure of 5 kg/cm$^2$. This gives a 20%-solids liquid dispersion of an amorphous polyester resin (A1) in which the volume-average diameter of particles is 160 nm.

Production of a Liquid Dispersion of a Crystalline Polyester Resin (C1)

Decanedioic acid: 81 parts
Hexanediol: 47 parts

These materials are loaded into a flask and heated to a temperature of 160° C. over 1 hour. After the reaction system has been stirred to uniformity, 0.03 parts of dibutyltin oxide is added. The temperature is increased to 200° C. over 6 hours while the water produced is removed by distillation, and stirring is continued for 4 hours at 200° C. Then the reaction solution is cooled until solids separate out, and the solids are collected and dried at a temperature of 40° C. under reduced pressure. This gives a crystalline polyester resin (C1) (melting point, 64° C.; weight-average molecular weight, 15,000).

The crystalline polyester resin (C1): 50 parts
An anionic surfactant (Neogen RK, DKS Co., Ltd.): 2 parts
Deionized water: 200 parts These materials are heated to 120° C. and sufficiently dispersed using a homogenizer (ULTRA-TURRAX T50, IKA). The resulting dispersion is subjected to further dispersion using a pressure-pump homogenizer and collected when the volume-average particle diameter is 180 nm. The dispersion obtained is a 20%-solids liquid dispersion of a crystalline polyester resin (C1).

Production of a Liquid Dispersion of Release-Agent Particles (W1)

Paraffin wax (HNP-9, Nippon Seiro Co., Ltd.): 100 parts
An anionic surfactant (Neogen RK, DKS Co., Ltd.): 1 part
Deionized water: 350 parts These materials are mixed together and heated to 100° C., dispersed using a homogenizer (IKA ULTRA-TURRAX T50), and then further dispersed using a pressure-pump Gaulin homogenizer. This gives a liquid dispersion of release-agent particles having a volume-average diameter of 200 nm. The solids content is adjusted to 20% with deionized water to complete a liquid dispersion of release-agent particles (W1).

Production of a Liquid Dispersion of Coloring-Agent Particles (K1)

Carbon black (Regal 330, Cabot): 50 parts
An anionic surfactant (Neogen RK, DKS Co., Ltd.): 5 parts
Deionized water: 195 parts These materials are mixed together and dispersed for 60 minutes using a high-pressure impact dispersing machine (Ultimaizer HJP30006, Sugino Machine). This gives a 20%-solids liquid dispersion of coloring-agent particles (K1).

Production of Black Toner Particles (K1)

Deionized water: 200 parts
The liquid dispersion of an amorphous polyester resin (A1): 150 parts
The liquid dispersion of a crystalline polyester resin (C1): 10 parts
The liquid dispersion of release-agent particles (W1): 10 parts
The liquid dispersion of coloring-agent particles (K1): 15 parts
An anionic surfactant (TaycaPower): 2.8 parts These materials are put into a stainless-steel round-bottom flask, the pH is adjusted to 3.5 with 0.1 N nitric acid, and then an aqueous solution of polyaluminum chloride prepared by dissolving 2 parts of polyaluminum chloride (Oji Paper Co., Ltd.; 30% powder) in 30 parts of deionized water is added. After dispersion at 30° C. using a homogenizer (IKA ULTRA-TURRAX T50), the mixture is heated to 45° C. in an oil bath for heating, and this state is maintained until the volume-average diameter of particles is 5.9 μm. Then 60 parts of the liquid dispersion of an amorphous polyester resin (A1) is added, and the mixture is allowed to stand for 30 minutes. When the volume-average diameter of particles is 6.2 μm, another 60 parts of the liquid dispersion of an amorphous polyester resin (A1) is added, and the mixture is allowed to stand for 30 minutes. Then 20 parts of a 10% aqueous solution of a metal salt of nitrilotriacetic acid (NTA) (CHELEST 70, Chelest Corporation) is added, and the pH is adjusted to 9.0 with a 1 N aqueous solution of sodium hydroxide. Then 1 part of the anionic surfactant (Tayca-Power) is added, the mixture is heated to 85° C. with continued stirring, and this state is maintained for 5 hours. Then the mixture is cooled to 20° C. at a rate of 20° C./min, the cooled mixture is filtered, and the residue is washed thoroughly with deionized water and dried. This gives black toner particles (K1) having a volume-average diameter of 6.5 μm.

Production of Black Toner (K1)

In a sample mill, 100 parts of the black toner particles (K1) and 1.5 parts of hydrophobic silica particles (RY50, Nippon Aerosil) are mixed for 30 seconds at a rotation speed of 10000 rpm. Screening the mixture using a vibrating sieve with a pore size of 45 μm gives a black toner (K1) in which the volume-average diameter of particles is 6.5 μm.

Production of Carriers

Example 1: Carrier (1)

The resin coating is formed through the following three stages using zinc stearate (StZn) as a lubricant. In the following, CHMA stands for cyclohexyl methacrylate.

Stage 1

Ferrite particles (volume-average diameter, 50 μm): 100 parts

CHMA resin (weight-average molecular weight, 100,000; volume-average particle diameter, 0.5 μm): 1.2 parts Carbon black (VXC72, Cabot): 0.08 parts These materials are mixed together using a Henschel mixer. Processing the resulting mixture at a rotation speed of 1000 rpm for 3 minutes using a dry-particle composing machine (Nobilta NOB130, Hosokawa Micron) gives a first form of particles, composed of ferrite particles and CHMA resin and carbon black attached to their surface.

Stage 2

The first form of particles: 100 parts

CHMA resin (weight-average molecular weight, 100,000; volume-average particle diameter, 0.5 μm): 0.8 parts Zinc stearate (volume-average particle diameter, 1.2 μm): 0.3 parts Carbon black (VXC72, Cabot): 0.08 parts These materials are mixed together using a Henschel mixer. Processing the resulting mixture at a rotation speed of 1000 rpm for 5 minutes using a dry-particle composing machine (Nobilta NOB130, Hosokawa Micron) gives a second form of particles, composed of the first form of particles and CHMA resin, zinc stearate, and carbon black attached to their surface.

Stage 3

The second form of particles: 100 parts

CHMA resin (weight-average molecular weight, 100,000; volume-average particle diameter, 0.5 μm): 0.7 parts Zinc stearate (volume-average particle diameter, 2.0 μm): 0.9 parts Carbon black (VXC72, Cabot): 0.08 parts These materials are mixed together using a Henschel mixer. Processing the resulting mixture at a rotation speed of 1200 rpm for 10 minutes using a dry-particle composing machine (Nobilta NOB130, Hosokawa Micron) gives particles composed of the second form of particles and CHMA resin, zinc stearate, and carbon black attached to their surface. The resulting particles are screened through a 75-μm mesh sieve to complete carrier (1).

Comparative Examples 1 and 2: Carriers (C1) and (C2)

Carriers (C1) and (C2) are produced in the same way as carrier (1). The amounts of materials used in stages 1, 2, and 3 are changed as in Table 1-1 and Table 1-2, and the diameters of the sets of particles of zinc stearate used are also modified.

Examples 2 to 9: Carriers (2) to (9)

Carriers (2) to (9) are produced in the same way as carrier (1). The amounts of materials used in one of stages 1, 2, and 3 are changed as in Table 1-1 and Table 1-2, and the diameters of the sets of particles of zinc stearate used are also modified.

Example 101: Carrier (101)

The resin coating is formed through the following three stages using melamine cyanurate (MC) as a lubricant.

Stage 1

Ferrite particles (volume-average diameter, 50 μm): 100 parts

CHMA resin (weight-average molecular weight, 100,000; volume-average particle diameter, 0.5 μm): 1.3 parts Carbon black (VXC72, Cabot): 0.08 parts These materials are mixed together using a Henschel mixer. Processing the resulting mixture at a rotation speed of 1000 rpm for 3 minutes using a dry-particle composing machine (Nobilta NOB130, Hosokawa Micron) gives a first form of particles, composed of ferrite particles and CHMA resin and carbon black attached to their surface.

Stage 2

The first form of particles: 100 parts

CHMA resin (weight-average molecular weight, 100,000; volume-average particle diameter, 0.5 μm): 1.0 part Melamine cyanurate (volume-average particle diameter, 1.0 μm): 0.3 parts Carbon black (VXC72, Cabot): 0.08 parts These materials are mixed together using a Henschel mixer. Processing the resulting mixture at a rotation speed of 1000 rpm for 5 minutes using a dry-particle composing machine (Nobilta NOB130, Hosokawa Micron) gives a second form of particles, composed of the first form of particles and CHMA resin, melamine cyanurate, and carbon black attached to their surface.

Stage 3

The second form of particles: 100 parts

CHMA resin (weight-average molecular weight, 100,000; volume-average particle diameter, 0.5 μm): 0.6 parts Melamine cyanurate (volume-average particle diameter, 1.8 μm): 0.8 parts Carbon black (VXC72, Cabot): 0.08 parts These materials are mixed together using a Henschel mixer. Processing the resulting mixture at a rotation speed of 1200 rpm for 5 minutes using a dry-particle composing machine (Nobilta NOB130, Hosokawa Micron) gives particles composed of the second form of particles and CHMA resin, melamine cyanurate, and carbon black attached to their surface. The resulting particles are screened through a 75-μm mesh sieve to complete carrier (101).

Comparative Examples 101 and 102: Carriers (C101) and (C102)

Carriers (C101) and (C102) are produced in the same way as carrier (101). The amounts of materials used in stages 1, 2, and 3 are changed as in Table 2-1 and Table 2-2, and the diameters of the sets of particles of melamine cyanurate used are also modified.

Examples 102 to 107: Carriers (102) to (107)

Carriers (102) to (107) are produced in the same way as carrier (101). The amounts of materials used in one of stages 1, 2, and 3 are changed as in Table 2-1 and Table 2-2, and the diameters of the sets of particles of melamine cyanurate used are also modified.

Production of Developers

Black developers are obtained by mixing each of the produced carriers with the black toner (K1). The carrier and the toner are put into a V-blender in a ratio of 100:8 (carrier to toner; by mass) and stirred for 20 minutes, and the stirred mixture is screened through a sieve with a pore size of 212 μm.

Performance Testing

A modified version of Fuji Xerox's DocuPrint 5100d is prepared as an image forming apparatus. Before image formation, the thickness of the outermost layer (charge transport layer) of the photoreceptor is measured using an eddy-current coating thickness gauge (Fischer Instruments). A total of 180 points of the layer are measured: 15 points along the longitudinal length of the photoreceptor (21-mm intervals) times 12 along the circumference (30° intervals).

Image Quality in a Relatively Early Period

A test chart with an area coverage of 2% is printed continuously on 1000 sheets of A4 portrait paper under the conditions of a temperature of 10° C. and a relative humidity of 10%. After the image forming apparatus is left overnight, a full-page half-tone image with an area coverage of 50% is printed on 10 sheets of A4 landscape paper. The ten full-page half-tone images are visually inspected, and image quality is graded as follows.

G1: Density is even throughout.

G2: Density is uneven, but to a very minor extent.

G3: Density is uneven, but to a practically acceptable extent.

G4: Density is uneven to a practically unacceptable extent.

Amount of Uneven Wear

After the above image forming task, a test chart with an area coverage of 2% is printed continuously on 500,000 sheets of A4 portrait paper under the conditions of a temperature of 10° C. and a relative humidity of 10%.

Then the thickness of the outermost layer of the photoreceptor is measured using an eddy-current coating thickness gauge (Fischer Instruments) at the same points as before image formation.

For each point, the change in measured thickness from before to after image formation is the amount of wear (μm). The smallest amount of wear across all measurement points is subtracted from the largest to give a difference (μm).

Image Defects Caused by Uneven Wear

After the above image forming task, the image forming apparatus is left under the conditions of a temperature of 10° C. and a relative humidity of 10% overnight. Then an A4 landscape blank image is printed on 10 sheets of paper of the same size. The ten blank printouts are visually inspected, and image quality is graded on the basis of black streaks and black spots (the number of black lines measuring 1 cm or longer/the number of sheets with black spots measuring 0.5 mm or larger) as follows.

G1: No such defect occurs.

G2: One or two/10 sheets.

G3: Three or more and less than ten/10 sheets.

G4: Ten or more/10 sheets.

TABLE 1-1

| | Stage 1 | | | | Stage 2 | | | | Stage 3 | | | | Resin coating |
|---|---|---|---|---|---|---|---|---|---|---|---|---|---|
| | Resin | | Lubricant | | Resin | | Lubricant | | Resin | | Lubricant | | Average |
| | Species — | Amount Parts | Species — | Amount Parts | Species — | Amount Parts | Species — | Amount Parts | Species — | Amount Parts | Species — | Amount Parts | thickness μm |
| Comparative Example 1 | CHMA | 1.0 | StZn | 0.3 | CHMA | 1.0 | StZn | 0.3 | CHMA | 1.0 | StZn | 0.3 | 3.5 |
| Comparative Example 2 | CHMA | 0.7 | StZn | 0.9 | CHMA | 0.8 | StZn | 0.3 | CHMA | 1.2 | — | 0 | 3.5 |
| Example 1 | CHMA | 1.2 | — | 0 | CHMA | 0.8 | StZn | 0.3 | CHMA | 0.7 | StZn | 0.9 | 3.5 |
| Example 2 | CHMA | 1.1 | StZn | 0.1 | CHMA | 0.9 | StZn | 0.2 | CHMA | 0.6 | StZn | 1.0 | 3.6 |
| Example 3 | CHMA | 1.2 | — | 0 | CHMA | 0.9 | StZn | 0.4 | CHMA | 0.6 | StZn | 0.8 | 3.4 |
| Example 4 | CHMA | 1.2 | — | 0 | CHMA | 1.0 | StZn | 0.3 | CHMA | 0.4 | StZn | 1.0 | 3.7 |
| Example 5 | CHMA | 1.0 | StZn | 0.3 | CHMA | 0.9 | StZn | 0.4 | CHMA | 0.8 | StZn | 0.5 | 3.2 |
| Example 6 | CHMA | 1.0 | StZn | 0.1 | CHMA | 0.5 | StZn | 0.8 | CHMA | 0.5 | StZn | 1.0 | 3.7 |
| Example 7 | CHMA | 1.3 | — | 0 | CHMA | 0.9 | StZn | 0.4 | CHMA | 0.8 | StZn | 0.5 | 3.3 |
| Example 8 | CHMA | 0.8 | StZn | 0.4 | CHMA | 0.5 | StZn | 0.6 | CHMA | 0.6 | StZn | 1.0 | 3.6 |
| Example 9 | CHMA | 1.1 | StZn | 0.2 | CHMA | 1.0 | StZn | 0.3 | CHMA | 0.9 | StZn | 0.4 | 3.3 |

TABLE 1-2

| | Dispersed phase of the lubricant | | | | | | | | | | |
|---|---|---|---|---|---|---|---|---|---|---|---|
| | Lubricant content (percentage area) | | | | | Mean major axis | | | | | Aspect |
| | Overall % | Top % | Middle % | Bottom % | Top/middle — | Overall μm | Top μm | Middle μm | Bottom μm | Top/middle — | ratio — |
| Comparative Example 1 | 23 | 24 | 24 | 20 | 1.0 | 1.3 | 1.5 | 1.2 | 1.2 | 1.3 | 1.2 |
| Comparative Example 2 | 25 | 0 | 25 | 50 | 0 | 1.4 | 0 | 1.3 | 1.4 | 0 | 1.4 |

TABLE 1-2-continued

| | | | | | | | | | | | |
|---|---|---|---|---|---|---|---|---|---|---|---|
| Example 1 | 25 | 60 | 26 | 0 | 2.3 | 1.5 | 1.5 | 1.2 | 0 | 1.3 | 1.4 |
| Example 2 | 28 | 60 | 15 | 8 | 4.0 | 1.6 | 1.8 | 1.2 | 1.1 | 1.5 | 1.8 |
| Example 3 | 31 | 56 | 37 | 0 | 1.5 | 1.5 | 1.6 | 1.4 | 0 | 1.1 | 1.7 |
| Example 4 | 34 | 68 | 33 | 0 | 2.1 | 1.6 | 1.8 | 1.2 | 0 | 1.5 | 1.8 |
| Example 5 | 30 | 39 | 29 | 21 | 1.3 | 1.5 | 1.6 | 1.5 | 1.3 | 1.1 | 1.4 |
| Example 6 | 46 | 68 | 60 | 10 | 1.1 | 1.8 | 1.9 | 1.8 | 1.2 | 1.1 | 1.9 |
| Example 7 | 21 | 40 | 22 | 0 | 1.8 | 1.3 | 1.3 | 1.2 | 0 | 1.1 | 1.2 |
| Example 8 | 48 | 60 | 49 | 35 | 1.2 | 1.7 | 1.8 | 1.6 | 1.4 | 1.1 | 1.7 |
| Example 9 | 23 | 30 | 20 | 18 | 1.5 | 1.2 | 1.3 | 1.2 | 1.0 | 1.1 | 1.2 |

| Image quality | Uneven wear | |
|---|---|---|
| in a relatively early period — | Difference in wear μm | Image quality — |
| G1 | 30 | G4 |
| G2 | 32 | G4 |
| G1 | 16 | G1 |
| G1 | 14 | G2 |
| G1 | 17 | G2 |
| G1 | 14 | G1 |
| G1 | 23 | G2 |
| G1 | 16 | G3 |
| G1 | 21 | G2 |
| G1 | 16 | G3 |
| G1 | 25 | G2 |

TABLE 2-1

| | Stage 1 | | | | Stage 2 | | | | Stage 3 | | | | Resin coating |
|---|---|---|---|---|---|---|---|---|---|---|---|---|---|
| | Resin | | Lubricant | | Resin | | Lubricant | | Resin | | Lubricant | | Average |
| | Species — | Amount Parts | Species — | Amount Parts | Species — | Amount Parts | Species — | Amount Parts | Species — | Amount Parts | Species — | Amount Parts | thickness μm |
| Comparative Example 101 | CHMA | 1.0 | MC | 0.3 | CHMA | 1.0 | MC | 0.3 | CHMA | 1.0 | MC | 0.3 | 3.5 |
| Comparative Example 102 | CHMA | 0.8 | MC | 0.5 | CHMA | 1.0 | MC | 0.3 | CHMA | 1.3 | — | 0 | 3.5 |
| Example 101 | CHMA | 1.3 | — | 0 | CHMA | 1.0 | MC | 0.3 | CHMA | 0.6 | MC | 0.8 | 3.6 |
| Example 102 | CHMA | 1.2 | MC | 0.1 | CHMA | 1.1 | MC | 0.2 | CHMA | 0.5 | MC | 0.8 | 3.6 |
| Example 103 | CHMA | 1.2 | MC | 0.1 | CHMA | 1.0 | MC | 0.3 | CHMA | 0.7 | MC | 0.6 | 3.5 |
| Example 104 | CHMA | 1.3 | — | 0 | CHMA | 1.1 | MC | 0.2 | CHMA | 0.4 | MC | 0.9 | 3.5 |
| Example 105 | CHMA | 1.3 | — | 0 | CHMA | 0.6 | MC | 0.7 | CHMA | 0.5 | MC | 0.8 | 3.6 |
| Example 106 | CHMA | 1.3 | — | 0 | CHMA | 0.7 | MC | 0.6 | CHMA | 0.5 | MC | 0.8 | 3.6 |
| Example 107 | CHMA | 1.1 | MC | 0.2 | CHMA | 1.0 | MC | 0.3 | CHMA | 0.9 | MC | 0.4 | 3.6 |

TABLE 2-2

| | Dispersed phase of the lubricant | | | | | | | | | | |
|---|---|---|---|---|---|---|---|---|---|---|---|
| | Lubricant content (percentage area) | | | | | Mean major axis | | | | | Aspect |
| | Overall % | Top % | Middle % | Bottom % | Top/middle — | Overall μm | Top μm | Middle μm | Bottom μm | Top/middle — | ratio — |
| Comparative Example 101 | 23 | 24 | 24 | 20 | 1.0 | 0.7 | 0.8 | 0.7 | 0.7 | 1.1 | 1.8 |
| Comparative Example 102 | 20 | 0 | 25 | 35 | 0 | 0.7 | 0 | 0.7 | 0.7 | 0 | 1.5 |
| Example 101 | 22 | 64 | 26 | 0 | 2.5 | 0.8 | 0.9 | 0.7 | 0 | 1.3 | 1.5 |
| Example 102 | 28 | 60 | 15 | 8 | 4.0 | 0.8 | 0.8 | 0.7 | 0.5 | 1.1 | 1.7 |
| Example 103 | 24 | 52 | 25 | 8 | 2.1 | 0.9 | 0.9 | 0.8 | 0.5 | 1.1 | 1.5 |
| Example 104 | 30 | 70 | 20 | 0 | 3.5 | 0.8 | 0.9 | 0.6 | 0 | 1.5 | 1.5 |
| Example 105 | 38 | 60 | 55 | 0 | 1.1 | 0.9 | 0.9 | 0.9 | 0 | 1.0 | 1.6 |
| Example 106 | 37 | 60 | 50 | 0 | 1.2 | 0.9 | 0.9 | 0.8 | 0 | 1.1 | 1.8 |
| Example 107 | 22 | 30 | 20 | 16 | 1.5 | 0.6 | 0.7 | 0.6 | 0.5 | 1.2 | 1.5 |

TABLE 2-2-continued

| | Image quality | Uneven wear | |
|---|---|---|---|
| | in a relatively early period — | Difference in wear μm | Image quality — |
| | G2 | 28 | G4 |
| | G3 | 29 | G4 |
| | G1 | 14 | G1 |
| | G1 | 14 | G3 |
| | G1 | 18 | G1 |
| | G1 | 15 | G2 |
| | G1 | 18 | G3 |
| | G1 | 15 | G3 |
| | G1 | 21 | G2 |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A carrier for developing an electrostatic charge image, the carrier comprising:

magnetic particles; and a resin coating that covers the magnetic particles and contains at least one lubricant, the resin coating having a dispersed phase of the lubricant and meeting requirement (1):

requirement (1): a lubricant content in a top layer>a lubricant content in a middle layer>a lubricant content in a bottom layer where the top, middle, and bottom layers are of the resin coating divided into three in a direction of thickness, and the lubricant content is a percentage area of the dispersed phase of the lubricant in a cross-section of the layer taken along a thickness thereof.

2. The carrier according to claim 1 for developing an electrostatic charge image, wherein a ratio between the lubricant content in the top layer and the lubricant content in the middle layer, the top layer/the middle layer, is 1.5 or more and 4.0 or less.

3. The carrier according to claim 2 for developing an electrostatic charge image, wherein the ratio between the lubricant content in the top layer and the lubricant content in the middle layer, the top layer/the middle layer, is 2.0 or more and 2.5 or less.

4. The carrier according to claim 1 for developing an electrostatic charge image, wherein the resin coating further meets requirement (2):

requirement (2): a mean major axis of the dispersed phase of the lubricant in the top layer>a mean major axis of the dispersed phase of the lubricant in the middle layer>a mean major axis of the dispersed phase of the lubricant in the bottom layer where the top, middle, and bottom layers are of the resin coating divided into three in the direction of thickness, and the mean major axis of the dispersed phase of the lubricant is an arithmetic mean of major axes of portions of the dispersed phase of the lubricant entirely contained in the layer.

5. The carrier according to claim 4 for developing an electrostatic charge image, wherein a ratio between the mean major axis of the dispersed phase of the lubricant in the top layer and the mean major axis of the dispersed phase of the lubricant in the middle layer, the top layer/the middle layer, is 1.0 or more and 2.0 or less.

6. The carrier according to claim 5 for developing an electrostatic charge image, wherein the ratio between the mean major axis of the dispersed phase of the lubricant in the top layer and the mean major axis of the dispersed phase of the lubricant in the middle layer, the top layer/the middle layer, is 1.2 or more and 1.5 or less.

7. The carrier according to claim 1 for developing an electrostatic charge image, wherein a mean aspect ratio, i.e., a mean ratio of a major axis to a minor axis, of the dispersed phase of the lubricant in the resin coating is 1.2 or more and 2.5 or less.

8. The carrier according to claim 7 for developing an electrostatic charge image, wherein the mean aspect ratio, i.e., the mean ratio of the major axis to the minor axis, of the dispersed phase of the lubricant in the resin coating is 1.2 or more and 1.5 or less.

9. The carrier according to claim 1 for developing an electrostatic charge image, wherein:

the lubricant content in the top layer is 20% or more and 60% or less; and the lubricant content in the middle layer is 10% or more and 50% or less.

10. The carrier according to claim 9 for developing an electrostatic charge image, wherein:

the lubricant content in the top layer is 30% or more and 50% or less; and the lubricant content in the middle layer is 10% or more and 30% or less.

11. The carrier according to claim 1 for developing an electrostatic charge image, wherein an average thickness of the resin coating is 0.3 μm or more and 10 μm or less.

12. The carrier according to claim 1 for developing an electrostatic charge image, wherein the lubricant includes at least one selected from the group consisting of a metal salt of a fatty acid and a layered compound.

13. The carrier according to claim 12 for developing an electrostatic charge image, wherein the lubricant includes at least one selected from the group consisting of a metal salt of stearic acid, melamine cyanurate, and mica.

14. The carrier according to claim 1 for developing an electrostatic charge image, wherein the resin coating contains an alicyclic (meth)acrylic resin.

15. The carrier according to claim 14 for developing an electrostatic charge image, wherein the resin coating contains cyclohexyl (meth)acrylate.

16. The carrier according to claim 1 for developing an electrostatic charge image, wherein a percentage exposed area of the magnetic particles is 0% or more and 5% or less.

17. An electrostatic charge image developer comprising the carrier according to claim 1 for developing an electrostatic charge image and a toner for developing an electrostatic charge image.

18. An image forming apparatus comprising:

an image carrier;

a charging component that charges a surface of the image carrier;

an electrostatic charge image creating component that creates an electrostatic charge image on the charged surface of the image carrier;

a developing component that contains the electrostatic charge image developer according to claim 14 and develops, using the electrostatic charge image developer, the electrostatic charge image created on the surface of the image carrier to form a toner image;

a transfer component that transfers the toner image on the surface of the image carrier to a surface of a recording medium; and a fixing component that fixes the toner image on the surface of the recording medium.

* * * * *